United States Patent [19]

Grenier

[11] 4,114,122

[45] Sep. 12, 1978

[54] CIRCUIT BREAKER

[75] Inventor: Aime J. Grenier, North Attleboro, Mass.

[73] Assignee: Texas Instruments Incorporated, Dallas, Tex.

[21] Appl. No.: 755,763

[22] Filed: Dec. 30, 1976

[51] Int. Cl.[2] ..... H01H 75/00; H01H 77/00; H01H 83/00

[52] U.S. Cl. ..... 335/8; 200/50 C; 335/9; 337/47

[58] Field of Search ..... 335/8, 9, 10, 159, 160; 337/45, 46, 47, 48; 200/50 C, 335, 5 B

[56] References Cited

U.S. PATENT DOCUMENTS

| | | | |
|---|---|---|---|
| 3,081,386 | 3/1963 | Koenig et al. | 335/9 |
| 3,198,898 | 8/1965 | Piteo, Jr. | 200/50 C |
| 3,299,231 | 1/1967 | Camp et al. | 200/50 C |
| 3,414,850 | 12/1968 | Cooper | 335/8 |
| 3,530,412 | 9/1970 | Gryctko | 335/8 |

*Primary Examiner*—Harold Broome

*Attorney, Agent, or Firm*—John A. Haug; James P. McAndrews

[57] ABSTRACT

A high performance, manually and automatically operable, trip-free magnetic circuit breaker incorporates novel means for mounting and coupling circuit breaker units to achieve multipole operation. An actuator in each pole has a shaft extending through a housing wall and fitting in splined engagement with the shaft of a corresponding actuator in an adjacent pole mounting the actuators for unison pivotal movement between a position where one of the actuators is engaged and pivoted by movement of the beaker contacts to an open circuit position in one pole for pivoting the other actuator to trip the breaker components in the adjacent pole to open the circuit in the adjacent pole. A tie-pin having a peripheral groove therein is snugly fitted into openings in the operating handles of the breaker pols and has coil springs fitted over the pin between pairs of the handles, one spring having a convolution of reduced diameter fitted into the pin groove for retaining the pin in the handle openings.

9 Claims, 26 Drawing Figures

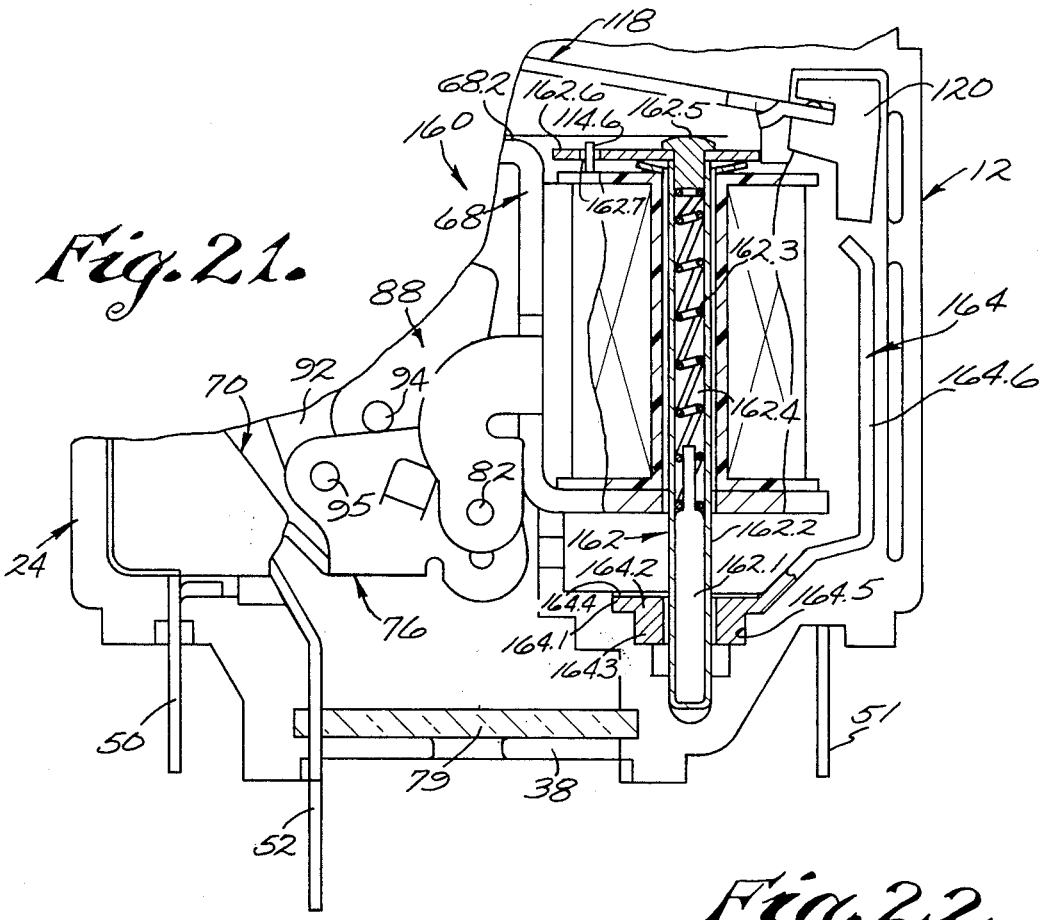
Fig. 21.
Fig. 22
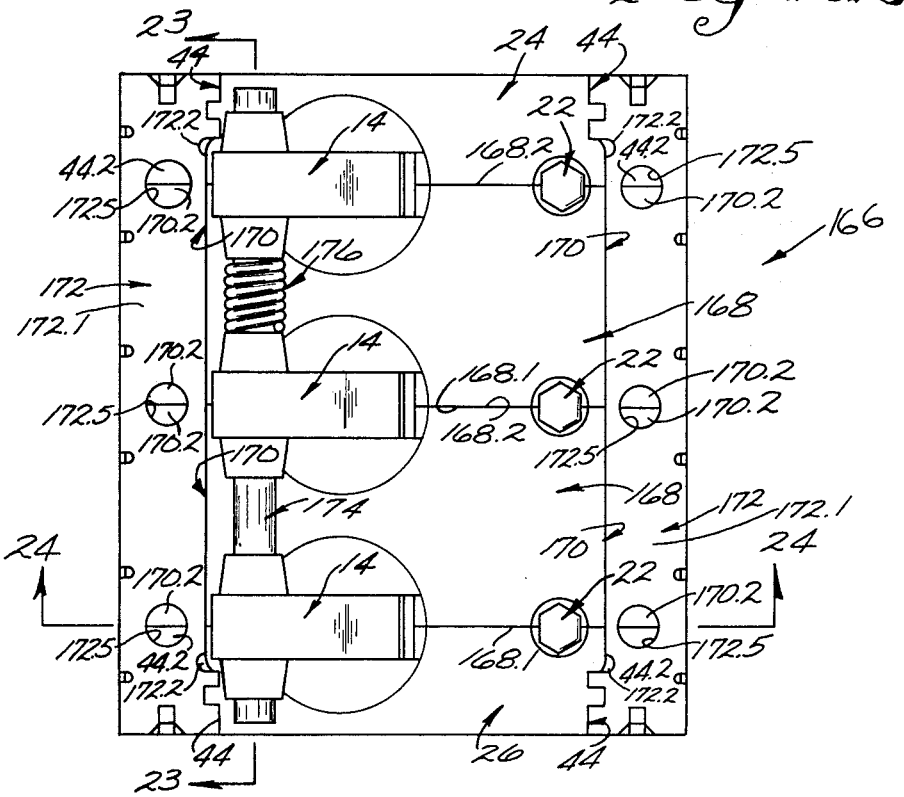

CIRCUIT BREAKER

Conventional high performance, manually and automatically operable, trip-free magnetic circuit breakers have been adaptable for use in series, shunt and relay trip application, for instantaneous or time delayed trip operation, for use as "flux switch" type circuit breakers where high transient currents in the breaker circuit have been anticipated, for use with auxiliary switches, and for use in multipole applications. However, such adaptability has been achieved only by substituting a substantial number of breaker components in adapting the breakers for each type of breaker operation. As a result, circuit breaker costs have been high due in part to the high unit cost of breaker components resulting from the need for many different tools and resulting from the small manufacturing volumes of some of the special breaker components. Breaker costs have also been increased by the need for maintaining a large inventory of many different breaker parts.

Most important, such conventional circuit breakers have required performance of a large number of critical hand operations during breaker assembly and calibration. These assembly operations have been time-consuming and expensive, have imposed excessive delay between customer order and delivery, have required the employment of skilled assembly personnel, have resulted in high rejection rates during assembly, have frequently prevented salvaging of components from improperly assembled breakers, and have resulted in the manufacture of breakers which have not displayed consistent performance characteristics.

For example, such known circuit breakers have frequently required welding of pigtails to movable contact arms, have utilized magnetic core means which have been soldered or cold-headed to the magnetic frame which supports the magnetic actuating coils in the breakers to obtain secure mounting of the core means relative to the coil means; and have required bending of latch components, clappers and the like at assembly to obtain proper interaction of breaker linkage systems with other breaker components. In some of the previously known circuit breakers, the collapsible linkages which have been used have required excessive riveting and in most such circuit breakers, breaker housing sections have been riveted together after breaker assembly and calibration has been completed.

Each of these assembly operations used in manufacturing the conventional circuit breakers has tended to impose cost and performance penalties. Thus, the critical hand assembly operations have been slow and expensive to perform as will be understood. They have also resulted in assembly errors which have seriously reduced manufacturing yields. Welding and soldering tend to introduce splatter which can result in immediate breaker failure or which can result in failure of the breakers during subsequent use. Welding, soldering, cold-heading and bending also tend to destroy corrosion-preventing coatings provided on some breaker components. These assembly operations also introduce material stresses such as work-hardening which are deleterious to breaker performance. For example, welding of pigtails can result in stiff pigtail movement which prevents smooth movement of the contact arm during breaker operation. The cold-heading of a magnetic core means in mounting the core means on a coil-supporting frame introduces work-hardening which can result in the build-up of residual magnetism in the cold-headed components during subsequent use of the circuit breaker. Riveting of the components of a collapsible linkage risks tight operation of the linkage which can retard proper opening of the circuit breaker. Riveting of the casing also tends to result in cracking of dielectric casing parts. Further, where such welding, soldering, cold-heading or riveting result in errors of assembly, salvaging of the welded, soldered, cold-headed or riveted parts is usually difficult and expensive.

In addition, some previously known circuit breakers have been subject to various structural deficiences which have reduced the convenience or effectiveness of their performance. For example, where the housings of such breakers have been riveted together, the rivets have sometimes contributed to arcing or shorting outside the breaker housings particularly where high overload current conditions have occurred in multipole breaker applications. In most such known breakers the collapsible linkages have been subjected to heavy loads so that all of the linkage elements have been made of metal. In such linkages, even slight corrosion of the metal elements in metal-to-metal pressure engagement can result in retardation of linkage movement and such breakers have sometimes required lubrication when used in hostile environments. In other known breakers, where a clapper is adapted to be drawn into engagement with a magnet pole face and to strike a breaker tripping element during such movement, it has been difficult to precisely position the clapper to assure proper tripping. That is, if the clapper engages the tripping element too far away from the pole face, the clapper force may be too small to initiate tripping. On the other hand if the clapper strikes the tripping element too close to the pole face, the extent of the resulting movement of the tripping element may be insufficient to effect tripping.

In some previously known circuit breakers, calibration of the breaker units has been accomplished from the side of the breaker. Accordingly, when a group of such units is used in a multipole breaker application, the calibration had to be completed before assembly of the units in the desired multipole arrangement. However, because the individual breaker units have been subject to a different magnetic environment in the multipole arrangement, such calibration prior to a final assembly has not always been fully effective. Further, the prior art techniques used for coupling breaker handles and the like in multipole applications have tended to be somewhat inconvenient to use. In addition, where previously known breakers have been used with auxiliary switches, the additional forces required for operation of the auxiliary switches have sometimes made it difficult to properly calibrate the breakers or to obtain uniform and reliable breaker performance. Similarly, where the prior art breakers have been adapted for flux switch operation, the breakers have been difficult to calibrate and have not always been adapted to withstand suitably high transient currents without nuisance tripping.

It is an object of this invention to provide a novel and improved, high performance, manually and automatically operable, trip-free magnetic circuit breaker; to provide such a circuit breaker which is of compact, rugged and inexpensive construction; to provide such a breaker which is readily adaptable at low cost for use in wide variety of circuit breaker applications; to provide such a circuit breaker which is easily and rapidly assembled; to provide such a breaker which is adapted to be assembled without requiring hand adjustments during such assembly; to provide such circuit breakers which display consistent performance characteristics; to provide such circuit breakers which are of compact construction and small size but which display improved rupture capacity; to provide such circuit breakers which are adapted to be easily, accurately and conveniently calibrated; to provide such circuit breakers which are easily and accurately calibrated after assembly in a multipole circuit breaker arrangement; to provide such circuit breakers which are adapted to withstand substantial wear over a long service life; to provide such circuit breakers which display improved resistance to corrosion and which are significantly less subject to jamming as a result of corrosion; to provide such circuit breakers which are operable in hostile environments without requiring lubrication; to provide such circuit breakers in which build-up of residual magnetism does not tend to occur; to provide such circuit breakers from which breaker components are eaily salvaged at any time; to provide such circuit breakers which do not require extensive riveting during assembly; to provide such circuit breakers which are adapted to be manufactured with high manufacturing yields; to provide such circuit breakers which are easily mounted on control panels; to provide such circuit breakers which are easily calibrated after adaptation for auxiliary switch application; to provide such circuit breakers which are conveniently coupled together for multipole operation; and to provide such circuit breakers which are easily calibrated and which display reduced nuisance tripping when adapted for flux type circuit breaker application.

Briefly described, the circuit breaker of this invention comprises a pair of dielectric casing sections fitted together to form a housing having terminal openings between the sections at one end of the housing. Abutments are provided on the exterior surfaces of the casing sections adjacent the openings, and terminals which are disposed in the openings have tabs deformed around the abutments for holding the casing sections together at that end of the housing. Mounting and cam surfaces are also provided on the exterior surfaces of the casing sections at the corners of the opposite end of the housing. Metal clips fit over these exterior casing surfaces, the clips having cam surfaces engaged with the cam surfaces on the casing sections for holding the casing sections together with a precisely perdetermined force. The clips have detent means which position the clips until circuit breaker assembly have been tested and have tabs which are deformed after testing for locking the clips permanently in place. The clips are provided with tapped mounting holes. In this arrangement, the housing is easily and accurately assembled without risk of cracking the dielectric casing sections; the housing is free of rivets which might reduce electrical clearances in the breaker; if dissassembly is required, the casing sections and clips are fully reuseable; and the housing is adapted for conveniently mounting on a control panel without requiring mounting inserts in the housing.

The circuit breaker also includes an improved contact system in which a pair of first contacts are mounted in spaced relation in the housing and in which a movable contact arm is pivotally mounted on the housing for moving a bifurcated end of the arm into and out of bridging engagement with the first contacts for opening and closing the breaker circuit. The movable contact arm is normally biased to open circuit position. In this arrangment, no pigtails need be welded to the movable contact arm; a double contact break is obtained; and the arrangment of the contact arm is adapted to achieve improved blow out of arcs formed during opening of the breaker circuit. Thus the current breaker achieves more consistent performance, longer service life and improved rupture capacity.

The circuit breaker also includes an improved collapsible linkage for permitting opening and closing of the breaker circuit in response to manual movement of an operating handle and for permitting automatic opening of the breaker circuit when the linkage is tripped on the occurrence of an overload current in the circuit. In the linkage, a first link has one end pivotally connected to the operating handle and has a first latch which is engaged with the contact arm and which is pivotally mounted at the opposite end of the first link for movement between latching and unlatching positions. The first latch has a cam surface to be engaged for manually holding the first latch in its latching position. A second link having a cam follower is pivotally mounted on the first link for movement between a first position engaging the cam follower with the cam surface of the first latch for holding the first latch in its latching position and a second position in which the cam follower is disengaged from the first latch. A second latch, also pivotally mounted on the first link, is movable from a latching position holding the second link in its first position to an unlatching position in which the second link is permitted to move to its second position. A tripping member also pivotally mounted on the first link normally holds the second latch in its latching position but is trippable by an applied force for releasing the second latch for movement to its unlatching position. When the first and second latches are in the latching positions as described, movement of the operating handle between two circuit positions is effective to move the linkage through an overcenter position against the bias on the movable contact arm, thereby to hold the arm securely in closed position or to permit the arm to move sharply to open circuit position. Tripping of the tripping member by an applied force on the occurrence of an overload current in the breaker circuit is also effective to collapse the linkage for permitting the contact arm to move sharply to open circuit position independently of the position of the operating handle.

In the dual latch linkage system of this invention, the links, latches and tripping member are arranged to provide cumulative mechanical advantage such that, although the movable contact arm is normally held in closed circuit position with substantial force, the tripping member is adapted to retain the second latch in its latching position with a much smaller force. Preferably also the tripping member is formed of precision molded plastic lubricity material. In this arrangement, only a relatively light force need be applied to the tripping member for initiating automatic circuit-opening operation of the circuit breaker. Further, although the plastic tripping member is adapted to withstand the light forces applied to it without cold flow or excessive wear, the tripping member is formed with such precision that the linkage is adapted to be easily and accurately assembled inside the circuit breaker and does not require cutting, trimming or bending or the like during final circuit breaker assembly. In addition, the plastic tripping member is not subject to corrosion even in hostile environments and there is no metal-to-metal pressure contact between the plastic tripper and the second latch. Accordingly, the linkage provides smooth and consistent circuit breaker performance and does not require lubrication at assembly.

The circuit breaker of this invention also includes a clapper which is magnetically movable from a rest position to an actuating position for tripping the tripping member of the collapsible linkage as above described, a magnetic frame supporting a magnetic coil to be responsive to current conditions in the breaker circuit, and magnetic core means fitted within the coil to cooperate with the frame in defining a magnetic circuit for moving the clapper to its actuating position in the occurrence of an overcurrent condition on the breaker circuit. The frame engages abutments formed on the inner surfaces of the casing sections of the housing for mounting and precisely locating the frame within the housing chamber; the coil is wound on a hollow spool mounted on the frame, the spool having resilient fingers positioned at one end of the spool; the core has a flange at one end engaged with additional abutments on the casing sections for mounting and precisely locating the core in the chamber while permitting the core to extend into the coil to be precisely located relative to the coil by engagement with the resilient fingers on the coil spool; and the clapper engages other abutments on the casing for mounting and precisely locating the clapper for pivotal movement relative to the core and frame within the housing chamber. Preferably, the clapper engages additional abutment means on the inner surface of the casing section for properly positioning the clapper in its rest position in the chamber. Preferably also the portion of the operating handle pivotally connected to the collapsible linkage engages other abutments on the inner surface of the casing sections. In this arrangement, where the operating handle and the various magnetic components of the circuit breaker are all located by abutments provided on the same precision molded casing sections, the components are easily and accurately located in the breaker relative to each other and to the tripping member of the collapsible linkage. The magnetic components are accurately located without requiring cutting, bending or trimming during final circuit breaker assembly and without requiring soldering or cold heading or the like such as might introduce work hardening or other undesired material stresses. The magnetic components are also easily disassembled for salvaging or the like free of damage to any of the components whenever such disassembly is desired.

The circuit breaker also includes an improved calibration system in which a calibrating member has a first portion rotatably mounted in the housing wall adjacent the operating handle and has a second threaded portion extending into the housing chamber to be rotatable with the first portion. A tension coil spring has a convolution at one end fitted in threaded engagement with the threaded portion of the calibrating member and has its opposite end connected to the clapper for biasing the clapper to its rest position, whereby the spring applies a selected force to the clapper in a selected direction but is movable in response to rotation of the calibrating member for threadedly advancing said one end of the spring on the calibrating member. In this way, the spring applies substantially the same spring force to the clapper but applied that force in a different direction so that the spring force has a different moment arm relative to the clapper pivot for calibrating the circuit breaker. In this arrangement, substantial rotation of the calibrating member produces small variation of the bias on the clapper to achieve high resolution in calibration of the breaker. The calibration system is also compact and inexpensive and is located at the operating handle end of the breaker to be readily accessible even when several of the circuit breakers are mounted together in a multipole circuit breaker application. The calibrating member is also substantially free of springback for assuring accurate calibration; the spring is not subjected to greatly varying stresses during use and therefore provides consistent performance at various calibrations over a long service life; and where initial tension is provided in a spring with a low sprig rate as is preferred, the spring provides the desired torque in a compact spring configuration while assuring that the torque does not increase significantly as the clapper is moved between its rest and actuating position, thereby resulting in a snappier clapper action.

The circuit breaker also includes an improved auxiliary switch mechanism; an improved flux member for use in adapting the breaker for flux type circuit breaker application; an improved multipole actuator system for tripping all of the circuit breakers in a multipole breaker when one of the poles has been tripped; an improved system for ganging operating handles of the circuit breaker units in a multipole circuit breaker; alternate terminals for use in adapting the circuit breaker for series, shunt or relay type applications; and a modular construction which permit convenient adaption of the breaker for use in a variety of different types of circuit breaker applications.

Other objects, advantages and details of the circuit breaker of this invention appear in the following detailed description of preferred embodiments of the invention, the detailed description referring to the drawings in which:

FIG. 21 is a partial elevation view similar to FIG. 8 illustrating an embodiment of the circuit breaker of FIG. 1 adapted for "flux-switch" type circuit breaker operation;

FIG. 22 is a top elevation view similar to FIG. 4 illustrating a multipole circuit breaker of this invention;

Figure 1:
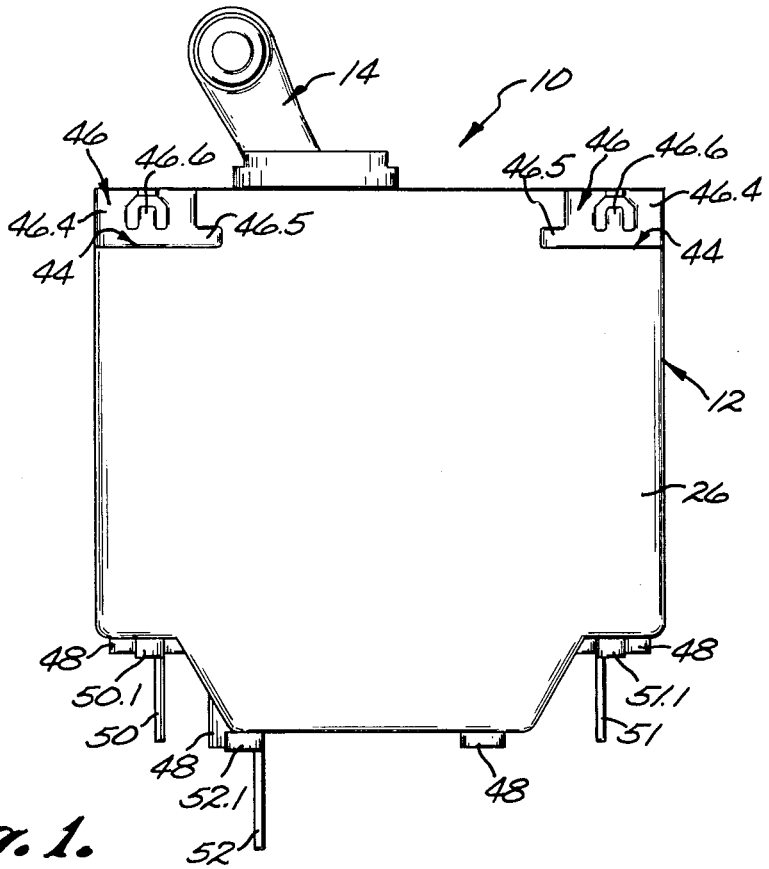
FIG. 1 is a side elevation view of a shunt trip embodiment of the circuit breaker of this invention.
Figure 2:
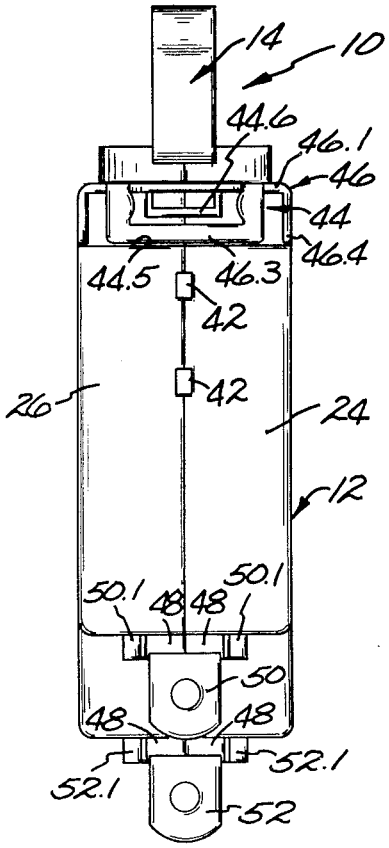
FIG. 2 is one end elevation view of the circuit breaker of FIG. 1.

Referring to the drawings, 10 in FIGS. 1–15 indicates a preferred embodiment of the novel and improved circuit breaker of this invention which provides for manual opening and closing of a circuit and for automatic, trip-free operation in response to the occurrence of an overload current or voltage in the circuit and which, in the embodiment illustrated in FIGS. 1–15, is adapted for shunt-trip type of circuit breaker application. As illustrated, the circuit breaker 10 is shown to include a housing indicated generally at 12, an operating handle 14, a contact system indicated generally at 16 (see FIGS. 8–13), a collapsible linkage 18 (see FIGS. 8–11), a magnetic actuation system indicated generally at 20 (see FIGS. 8–11, 14 and 15), and a calibration system indicated generally at 22 (see FIGS. 4 and 8–11).

The base or housing 12 embodies a pair of casing or housing sections 24 and 26 of a rigid dielectric material such as thermoplastic polyester, phenolic resin, glass-filled nylon or the like which are preferably formed in precision molding processes or the like so that each casing section has a plurality of structural features precisely located relative to each other on the section at very low cost. Preferably, the casing section 24 has a generally flat principal wall 24.1 and has edge walls 24.2, 24.3, 24.4 and 24.5 upstanding from the principal wall. See FIG. 7. The casing section 26 is of generally similar configuration, the edge walls of the two casing sections being fitted together to define a housing chamber 28 as shown in FIGS. 7–11. Preferably located surfaces such as those formed by upstanding abutments 24.6 and bosses 24.7 are provided on the edge walls of the casing section 24 (see FIG. 7) while corresponding locating surfaces in the form of interfitting abutments and recesses are provided on the edge walls of the casing section 26 for permitting the casing sections to be easily and accurately fitted together. The edge walls of the casing sections also have recesses, notches or slots which cooperate when the sections are fitted together to define a plurality of openings extending into the housing chamber 28, these openings including terminal openings 30 and 32 at one end of the housing 12, a bottom opening 38 at that end of the housing, an opening 34 for the operating handle 14 at the opposite end of the housing 12 and an opening 36 for the calibration system 22 adjacent to the operating handle opening at said opposite housing end. Preferably such slots and the like in the edge walls of the casing sections also cooperate to form an arc vent opening 40 (see FIG. 3) and test openings 42 (see FIG. 2) in the housing as is discussed further below.

In accordance with this invention the exterior surfaces of the casing sections have a plurality of mounting surfaces and the like integrally formed on the casing sections and precisely located relative to each other on the casing exterior for use in achieving convenient, accurate and high-yield assembly of the housing 12. That is, each corner area of the casing section 24 to be disposed at the operating handle end of the housing 12 has a recess configuration 44 on its exterior surface defining a clamping cam surface 44.1 (see FIG. 4) and a clearance recess 44.2 on the edge wall 24.2, defining a guide cam surface 44.3 and a locking slot 44.4 on the principal wall 24.1, and defining a slot 44.5 to form a detent abutment 44.6 on a lateral edge wall 24.4 or 24.5. The clamping cam surface 44.1 is spaced a selected precise distance from locating surfaces on the edge wall 24.2 of the casing section, and the guide cam surface 44.3 has a slight downward tilt or incline as viewed in FIG. 6. Corresponding corner areas of the casing section 26 have corresponding recess configurations 44.

Figure 4:
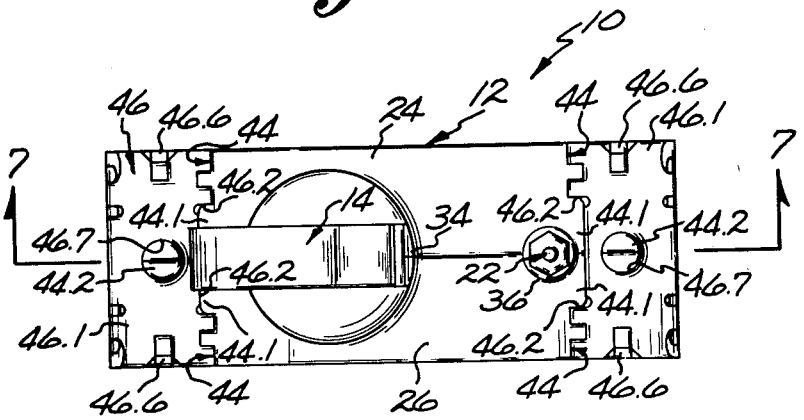
FIG. 4 is a top elevation view of the circuit breaker of FIG. 1.

A metal mounting clip 46 or the like is then fitted within a pair of recess configurations 44 formed on the respective casing sections 24 and 26, the clip being provided with various structural features which cooperate with the mounting surfaces and the like formed by the recess configurations on the casing sections to hold the casing sections together, temporarily or permanently, to form the housing 12. That is, the clip 46 includes a top sheet portion 46.1 having a cam slot 46.2 which, as shown in FIG. 4 engages the clamping cam surfaces 44.1 on the casing sections 24 and 26 for holding the sections together. As the cam slot 46.2 is shallow and is formed in a sheet portion of the clip, the edges of the cam slot are adapted to be precisely formed by a simple blanking operation and are therefore adapted to hold the casing sections securely together with a precisely predetermined force without risk of cracking the dielectric casing section materials. An apertured detent clip portion 46.3 disposed in a plane perpendicular to the top clip portion 46.1, and two guide clip portions 46.4 disposed in planes perpendicular to the top and detent portions of the clip, then cooperate with surfaces on the casing sections to properly position and hold the clip on the casing sections, the guide portions of the clip having tangs 46.5 which engage respective inclined guide cam surfaces 44.3 on the casing sections as the clip 46 is fitted over the corner areas of the housing for applying stress to the clip guide portions as the apertured detent portion of the clip is snapped over the detent abutments 44.6 on the casing sections, thereby to temporarily hold the clip on the casing sections with the clamping cam surfaces of the clip and casing sections properly engaged. Such temporary mounting of the clip permits the circuit breakers to be tested after assembly without need for other temporary holding means for the housing sections. The metal clips 46 fit snugly into the recess configurations in the casing section to be flush with the exterior section surfaces outside the recess configurations to achieve a compact housing structure. However, because the casing sections are held together by the clamping cam surfaces, the fit of the clip guide portions against the principal walls of the casing sections is not relied upon for holding the sections together. That is, if the clip guide portions display any resilience, the securing of the casing sections together is not affected by such resilience. Each guide portion of the clip 46 has a locking tab 46.6 which is deformed into a corresponding locking slot 44.4 in a casing section after testing of the breaker and after it has been established that the circuit breaker 10 has been properly assembled, thereby to lock the mounting clips more or less permanently in place on the casing sections. However, as it is the fitting of the tabs 46.6 into the locking slots which secures the clips in place rather than any clamping of the casing sections by the deformed tabs, there is no risk of cracking the casing materials during deformation of the tabs. Of course, if desired, the tabs 46.6 are adapted to be redeformed out of the locking slots if disassembly of the circuit breaker should ever be desired, thereby to permit such disassembly without risk of damage to the casing sections. Each mounting clip 46 also has a tapped or threaded hole 46.7 therein aligned with the clearance recesses 44.2 formed in the casing sections, whereby mounting screws are adapted to be engaged with the clip for mounting the circuit breaker 10 on a control panel or the like where desired.

Figure 5:
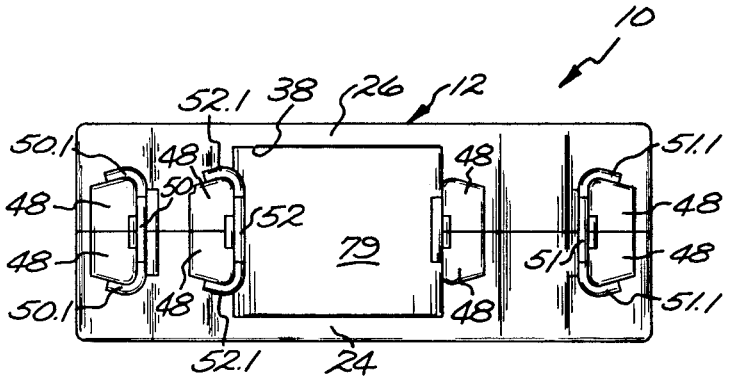
FIG. 5 is a bottom elevation view of the circuit breaker of FIG. 1.
Figure 6:
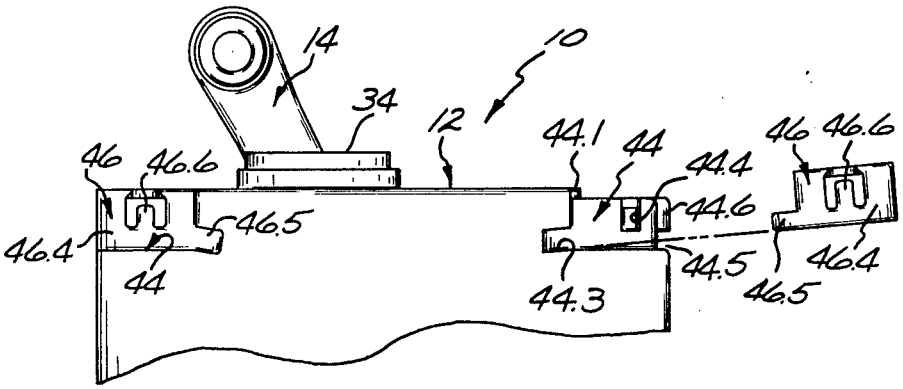
FIG. 6 is a partial side elevation view of the circuit breaker of FIG. 1 illustrating assembly of the mounting clip thereon.
Figure 7:
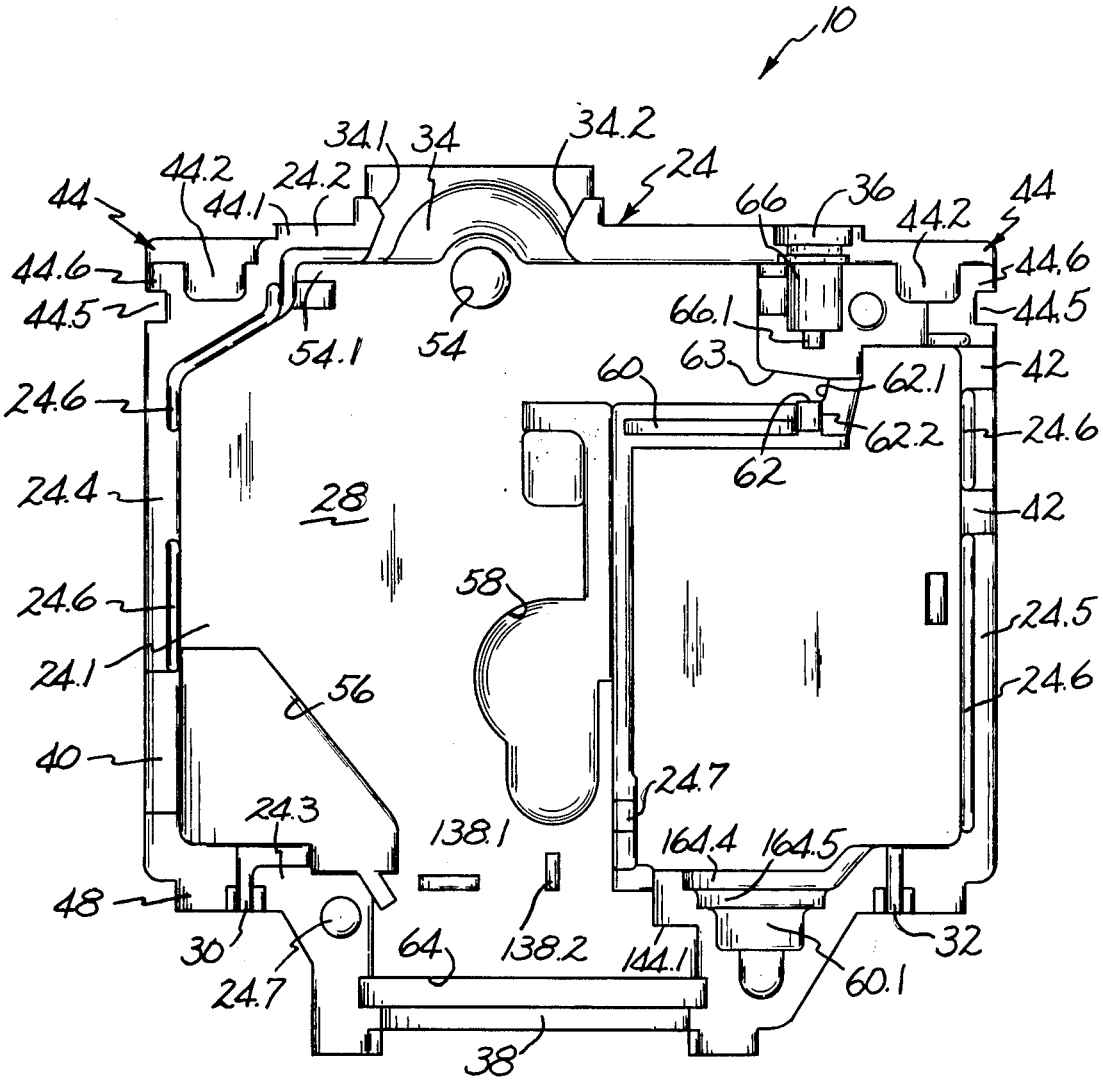
FIG. 7 is a section view along line 7-7 of FIG. 4 with the movable switch components removed illustrating the construction of one of the casing sections of the circuit breaker of FIG. 1.

Preferably, abutments 48 are also formed on the exterior surfaces of the casing sections 24 and 26 adjacent each of the terminal openings 30 and 32, and preferably adjacent each side of the bottom opening 38, at the other end of the housing 12. Breaker terminals 50 and 51 fitted into the openings 30 and 32 are then provided with tabs 50.1 and 51.1 which are deformed around pairs of the exterior casing abutments 48 adjacent the terminal openings after final breaker assembly for securely locking the casing sections together at that end of the housing as shown in FIG. 5. Where the circuit breaker 10 is adapted for shunt-trip type of circuit breaker operation as shown, an additional terminal 52 is extended through the bottom opening 38 in the housing 12 and tabs 52.1 on that terminal are deformed around a pair of the abutments 48 adjacent the opening 38.

In accordance with this invention, the casing sections 24 and 26 are also provided with a plurality of integral mounting surfaces, abutments and the like on the interior surfaces of the casing sections, whereby these interior casing features are also precisely located relative to each other in an inexpensive way for use in precisely locating various circuit breaker components relative to each other within the housing chamber 28. In the casing section 24 for example, such interior casing features (which are each discussed further below) include a recess 54 for use in pivotally mounting the operating handle 14 on the housing 12, a recess 54.1 forming a stop for a biasing spring for the operating handle, a recess 56 forming an abutment for locating an arc chute member in the chamber 28, a recess 58 forming abutments for locating a magnetic frame member in the chamber 28, a recess 60 and a recess 60.1 forming abutments for locating magnetic core means in the circuit breaker, abutments 62, 62.1 and 62.2 for use in locating a magnetic clapper in the chamber 28, a slot-shaped recess 64 for use in locating a cover over the bottom opening 38 in the housing, and recesses 66 and 66.1 for use in locating the calibration system 22 in the chamber 28. The casing section 26 has corresponding recess and abutment features formed on its interior surfaces for cooperating with the noted interior features of the casing section 24 in locating various circuit breaker components in the chamber 28.

Figure 8:
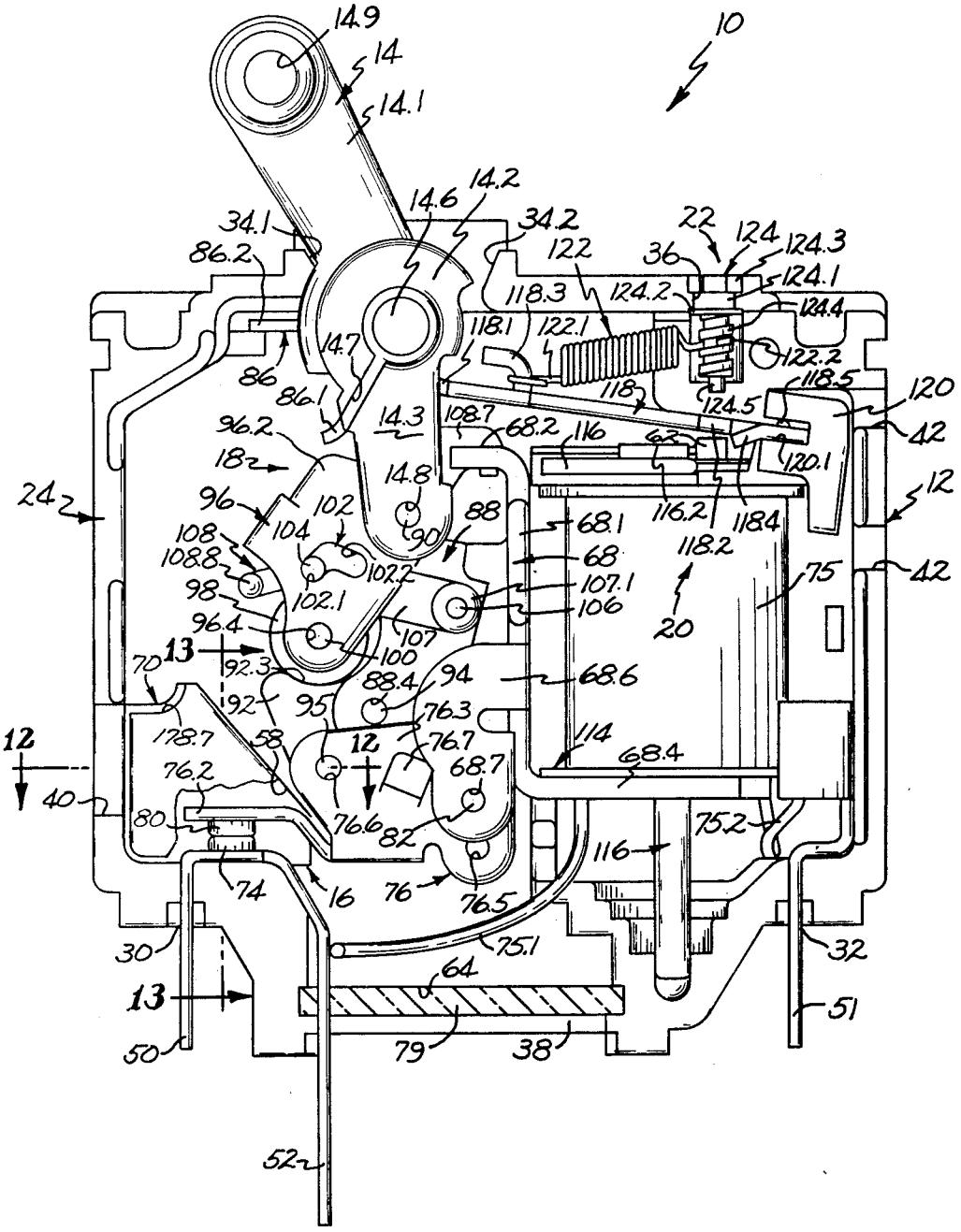
FIG. 8 is a section view similar to FIG. 7 showing the movable circuit breaker components mounted in the casing section of FIG. 7 with circuit the breaker in closed circuit position.

In the circuit breaker 10 of this invention, a frame 68 of a magnetically permeable metal material such as annealed steel is mounted in a central position in the housing chamber 28 as shown in FIG. 8. The frame has a central frame portion 68.1, has a pole face 68.2 extending from one end of the central frame portion, has a clearance slot 68.3 extending through the pole face 68.2 into the central frame portion, has a coil support arm 68.4 apertured at 68.5 (see FIG. 9) extending in one direction from the opposite end of the central frame portion, and has a pair of integral wings 68.6 extending in an opposite direction from said opposite end of the central frame portion in spaced juxtaposed relation to each other, the wings having respective, aligned pivot pin holes 68.7 therein. The frame 68 is mounted and precisely positioned in the housing chamber 28 by fitting one side of the frame in the recess 58 in the casing section 24 and by fitting the opposite side of the frame in a corresponding recess in the casing section 26, whereby the pole face 68.2 and the pivot pin holes 68.7 of the frame are precisely located in the chamber 28.

Figure 3:
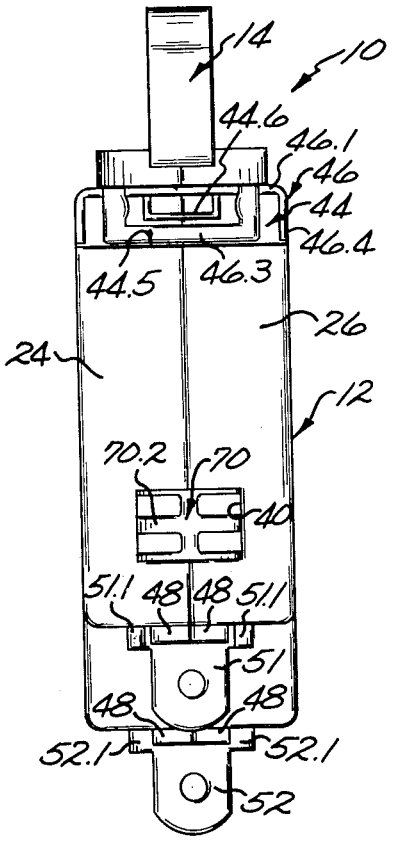
FIG. 3 is an opposite end elevation view of the circuit breaker of FIG. 1.

In the contact system 16 of the circuit breaker 10, an arc chute member 70 of a rigid dielectric material such as phenolic resin, glass-filled thermoplastic polyester or the like has a bottom wall 70.1, has an end wall 70.2, and has a pair of sloped outer side walls 70.3 and 70.4 spaced at either side of a similarly sloped central dividing wall 70.5 for forming contact chambers 70.6 and 70.7 at respective opposite sides of the dividing wall. See FIGS. 12 and 13. The outer side wall 70.3 and the dividing wall 70.5 have corresponding grooves 70.8 receiving the edges of one end of the breaker terminal 52 therein for mounting a first fixed contact 72 secured to the terminal 52 within the contact chamber 70.6. The bottom wall 70.1 of the arc chute member has a recess 70.9 therein and is open adjacent the end wall 70.2 for receiving one end of the breaker terminal 50 therein, thereby to mount a second fixed contact 74 attached to the terminal 50 within the contact chamber 70.7. The arc chute member 70 is mounted in the recess 56 in the casing section 24, and in a corresponding recess in the casing section 26 while the opposite ends of the terminals 50 and 50 are extended from the housing chamber 28 through openings 30 and 38 respectively in the housing 12. The terminal 51 is similarly mounted between the casing sections to extend from the housing chamber through the opening 32 in the housing. The end wall 70.2 of the arc chute member has a gridded aperture formed therein as best seen in FIG. 3, whereby the gridded aperture is aligned with the opening 40 in the housing so that the contact chambers 70.6 and 70.7 are each separately vented outside the circuit breaker housing 12. When a magnetic actuation coil 75, to be discussed further below, is mounted on the coil support arm 68.4 of the frame member, one end 75.2 of the coil is electrically connected to the line terminal 51 while the opposite end 75.2 of the coil is electrically connected to the shunt-trip terminal 52 as shown in FIG. 8.

In the contact system 16 of the circuit breaker 10, a second contact means, preferably a movable contact arm 76 of an electrically conductive metal material such as copper or brass, is also mounted for pivotal movement on the frame member 68. The contact arm has one end bifurcated as indicated at 76.1 and 76.2 (see FIG. 12), has a pair of spaced, integral, juxtaposed wings 76.3 at its opposite end fitted between the wings 68.6 of the frame member, and has an intermediate arm portion 76.4 which electrically connects the bifurcated arm ends to each other. A pair of electrical contacts 78 and 80 are mounted on the respective bifurcations 76.1 and 76.2, these bifuracted arm ends preferably being stepped as shown so that the intermediate arm portion 76.4 electrically connecting the bifurcations is disposed in substantially the same plane as the outer surfaces of the contacts 78 and 80. The wings 76.3 of the movable contact arm have respective aligned slots 76.5 therein, have respective aligned pivot pin holes 76.6, and each preferably have a tab 76.7 struck therefrom to extend toward the other wing of the contact arm. A pivot pin 82 extends through the contact arm slots 76.5 and through pivot pin holes 68.7 in the frame and the ends of the pin are positioned closely adjacent the principal walls of the casing sections 24 and 26 to assure retention of the pin in the slots 76.5 and holes 68.7. A double section coil spring fitted over the pin 82 has a central bight 84.1 bearing against the frame 68 and has its opposite ends 84.2 fitted under respective tabs 76.7 on the movable contact arm, thereby to bias the arm for pivotal movement in a clockwise direction as viewed in FIGS. 8 and 9. A pair of coiled torsion springs (right and left) could also be used.

In this arrangement, the contact arm 76 is pivotally mounted on the frame 68 for moving the bifurcated end of the contact arm toward or away from the plane occupied by the fixed contacts 72 and 74, whereby the contacts 78 and 80 are engaged with or disengaged from the respective fixed contacts 72 and 74. In this way, the contact arm is adapted to close a circuit between the fixed contacts 72 and 74 by bridging the fixed contacts. However, the arm is normally biased by the spring 84 to open that bridging circuit. Because a bridging circuit is adapted to be closed by pivoting of the contact arm 76, the convenience and desirable contact closing forces obtained with a pivotal contact arm are achieved but no flexible pigtail or the like such as might tend to retard smooth pivoting of the contact arm, or which might be subject to fatigue during use, need be attached to the movable arm. Further the use of the bridging contact arm 76 provides a double contact make and break in closing and opening the noted circuit, thereby permitting the contact system 16 to function with greater speed and with less arc erosion damage to the breaker contacts and to provide the breaker 10 with greater rupture capacity. The bifurcated ends 76.1 and 76.2 of the contact arm fit into respective contact chambers 70.6 and 70.7 so that the mating pairs of contact 72-78 and 74-80 are separated by the dividing wall 70.5 as the mating contact pairs are engaged and disengaged. In this way the fixed contacts 72 and 74 are adapted to be spaced closed together without risk of arcing therebetween and each mating contact pair is shielded from arc erosion splatter or the like originating at the other mating contact pair. Further, with this arrangement of the contact system 16, magnetic fields are formed by current flow in the terminals 50 and 52 and in the contact arm 76 during opening of the breaker circuit such that arcs formed between the mating contact pairs tend to remain separate and tend to be deflected in directions away from the contact arm to be vented from the contact chambers 70.6 and 70.7 through the housing vent opening 40 and to be extinguished in passing through the gridded aperture in the arc chute end wall 70.2. In this way, the single, one piece arc chute 70 handles all arcing problems and also facilitates contact mounting. Desirably, a cover member 79 of a stiff fiberboard material or the like, apertured to pass the terminal 52 therethrough, is mounted over the bottom opening 38 of the housing by disposing the edges of the cover in the slot recess 64 of the casing section 24 and in a corresponding slot recess in the casing section 26.

In the circuit breaker 10, the operating handle 14 is formed of a rigid dielectric material such as glass-filled nylon or the like and is provided with a manually movable portion 14.1 which extends in one direction from a central bridging portion 14.2 of the operating handle. A pair of legs 14.3 extend in an opposite direction from the central bridging portion in spaced side-by-side relation to each other to define a clearance space 14.4 therebetween. (See FIG. 9.) Pivot pin means 14.6 formed integral with the operating handle on the outer surfaces of each of the legs 14.3 are fitted into the recess 54 in the casing section 24, and into a corresponding recess in the casing section 26, respectively so that the operating handle is mounted for pivotal movement on the housing 12 with the handle portion 14.1 extending from the housing through the housing opening 34 and with the legs 14.3 extending into the housing chamber 28. In this arrangment, the operating handle is movable from the closed circuit position shown in FIG. 8 wherein the operating handle portion 14.1 engages a stop surface 34.1 on the housing 12 and an open circuit position shown in FIG. 10 wherein the handle portion 14.1 engages a stop surface 34.2 on the housing 12. Preferably at least one of the handle legs 14.3 has a stop surface 14.7 thereon and a coil spring 86 is fitted over one of the pivot pin means 14.6 with one spring end 86.1 engaged with the stop surface 14.7 and with the opposite spring end 86.2 fitted into the recess 54.1 on the casing section 24, thereby to normally bias the operating handle toward the open circuit position shown in FIG. 10. The legs 14.3 of the operating handle have respective aligned pivot pin holes 14.8 therein as shown in FIG. 8. The handle portions 14.1 also have holes 14.9 therein for use in multipole circuit breaker applications as described below.

Figure 9:
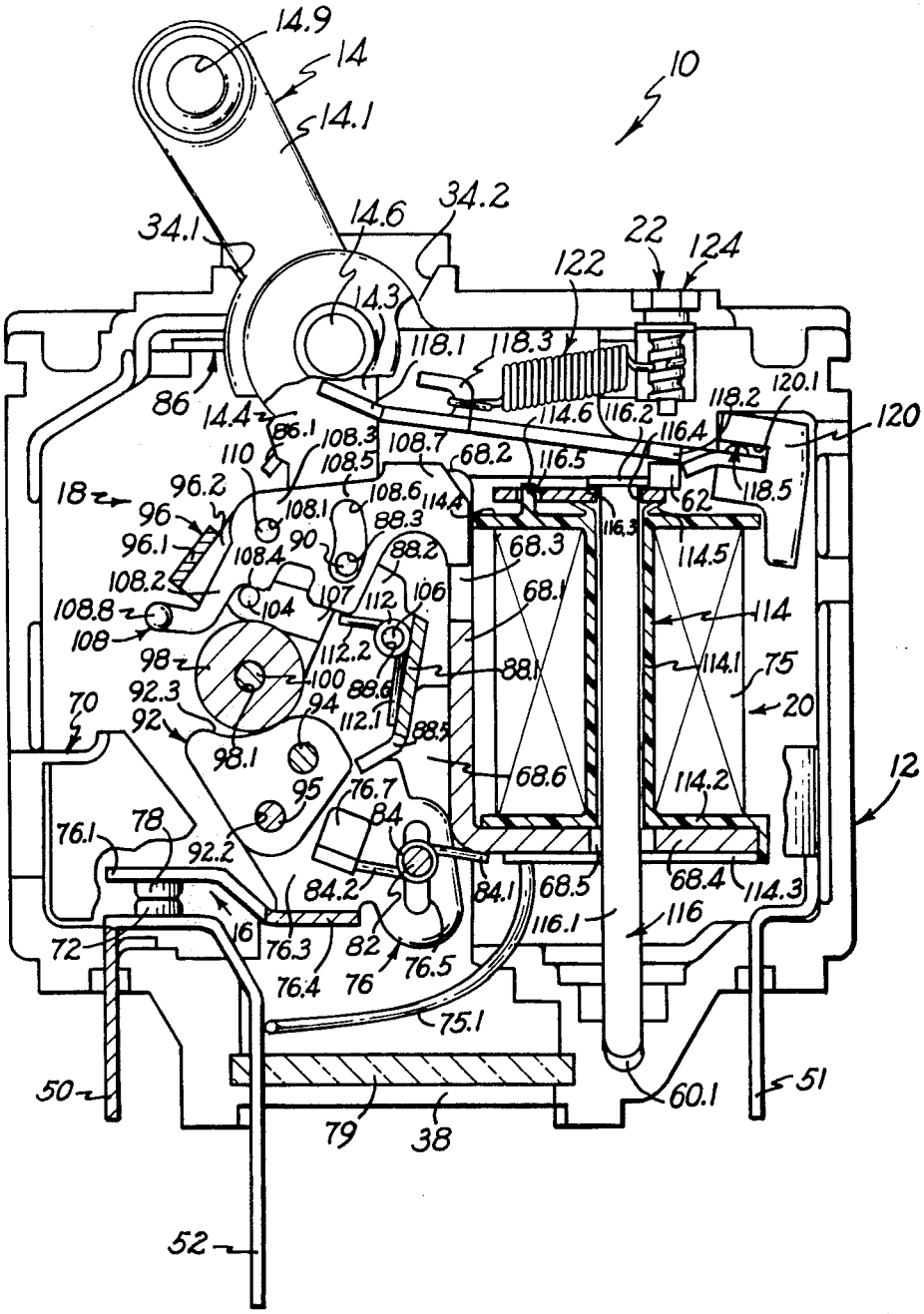
FIG. 9 is a section view similar to FIG. 8 showing the movable circuit breaker components in section.
Figure 10:
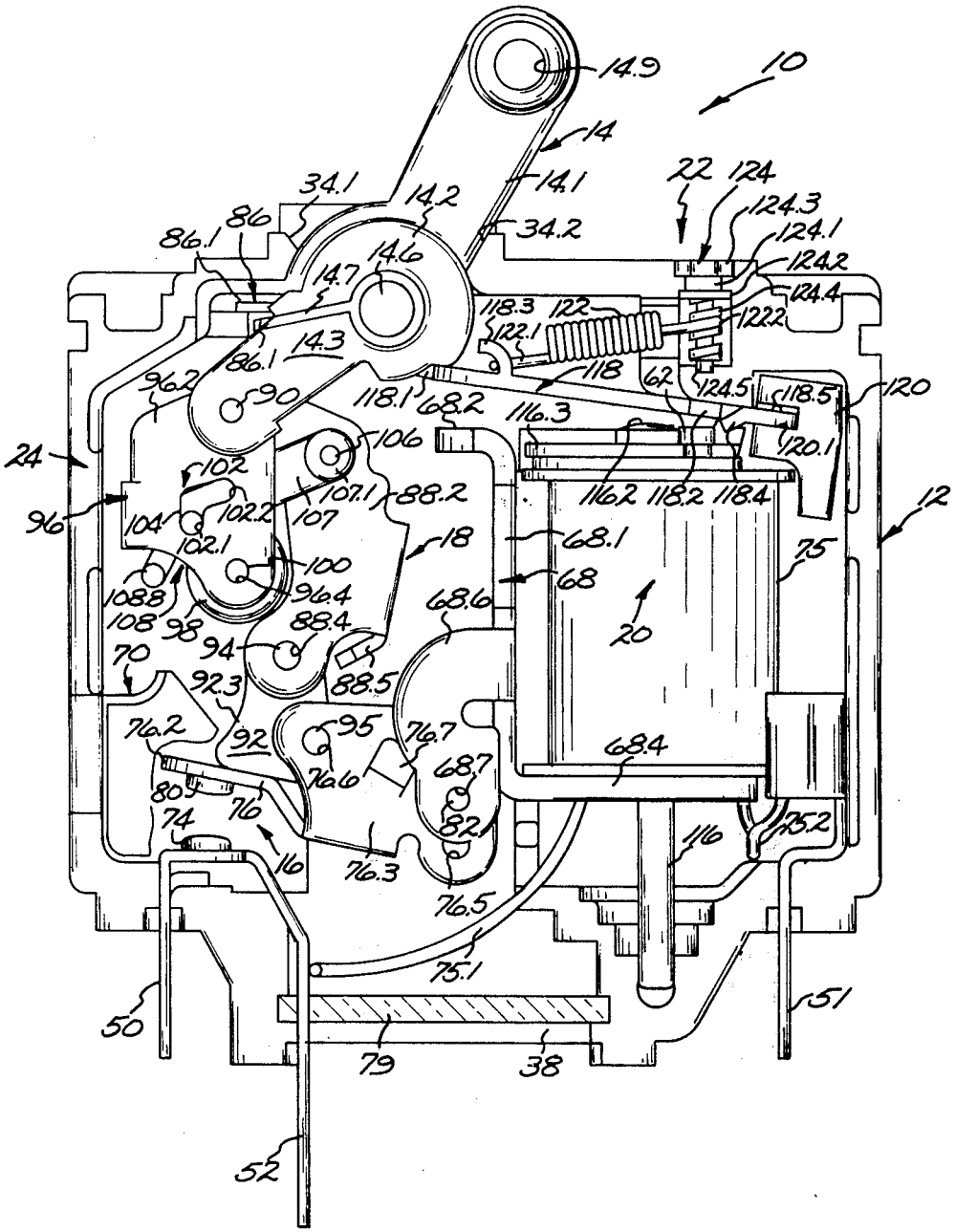
FIG. 10 is a section view similar to FIG. 8 showing the movable circuit breaker components in open circuit position after manual opening of the breaker circuit.
Figure 12:
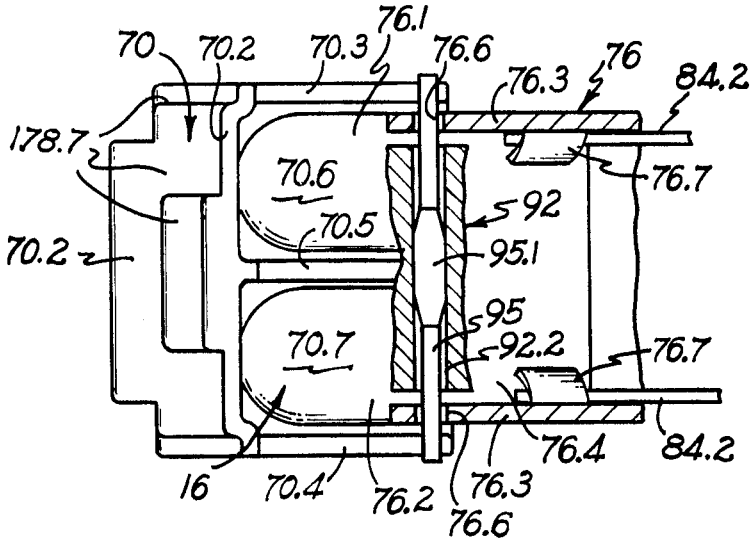
FIG. 12 is a partial section view along line 12—12 of FIG. 3.
Figure 13:
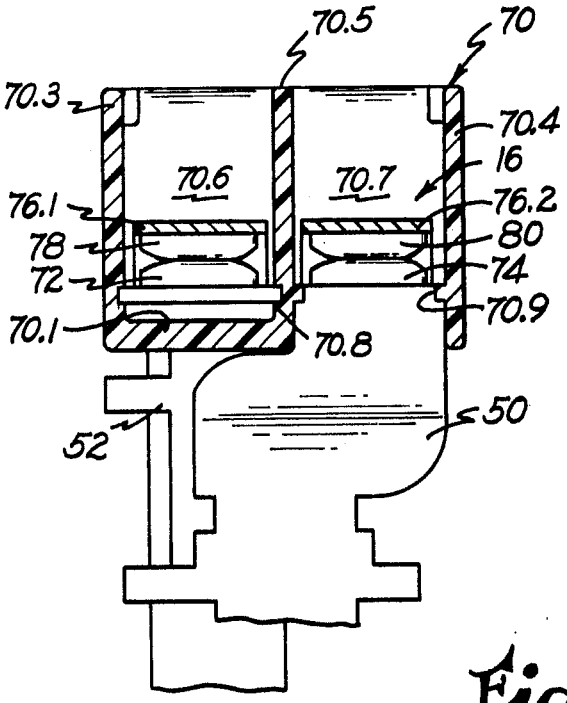
FIG. 13 is a partial section view along line 13—13 of FIG. 8.

In accordance with this invention, the circuit breaker 10 also includes a novel and improved collapsible linkage 18 for connecting the operating handle 14 to the movable contact arm 76. In this improved linkage or control mechanism, a first link 88, preferably formed of brass or other suitable strong and rigid material has a central portion 88.1 supporting a pair of spaced integral juxtaposed wings 88.2 giving the first link a generally U-shaped configuration. The wings 88.2 have respective aligned pivot pin holes 88.3 therein at one end of the link and have respective aligned rivet holes 88.4 therein at the opposite end of the like. A stop 88.5 is provided on the central portion of the link at said opposite link end. A pivot pin 90 extends through the pivot pin holes 88.3 in the first link and through the pivot pin holes 14.8 in the operating handle legs, thereby to pivotally mount said one end of the first link on the operating handle, the respective ends of the pin 90 being engaged with the principal walls of the casing sections 24 and 26 for retaining the pin for free rotation in the holes 88.3 and 14.8. A first latch 92, also preferably formed of a strong and rigid material such as steel is disposed between the wings 88.2 of the first link at said opposite end of the first link, the first latch having a substantial width to substantially fill the space between the wings 88.2 while permitting free movement of the first latch between the wings. A rivet 94 extends through the holes 88.4 in the wings of the first link and through a corresponding hole 92.1 in the latch 92, thereby to pivotally mount the first latch on the first link. The latch 92 also extends between the wings 76.3 of the contact arm 76 and a pivot pin 95 extends through pivot pin holes 76.6 in the contact arm and through a corresponding hole 92.2 in the first latch, thereby to pivotally connect the first latch to the contact arm. Preferably, as is shown in FIG. 12, the pin 95 has a central protuberance 95.1 positioned within the hole 92.2 in the first latch and the opposite ends of the pin fit next to the principal walls of the casing sections 24 and 26 for retaining the pin for free rotation in the holes 76.6 and 92.2. The first latch has a cam surface 92.3 thereon extending laterally out from a line connecting the latch pivot holes 92.1 and 92.2 as shown in FIG. 9. The latch 92 has a substantial width tending to minimize wear to the latch surface 92.3. The rivet 94 permits the latch plate 92 to pivot on the link 88 between the wings 76.3 of the contact arm and is the only rivet used in the linkage 18.

The collapsible linkage 18 then further includes a second link 96, also preferably formed of brass or other suitably strong and rigid material. The second link has a central portion 96.1 supporting a pair of spaced, integral, juxtaposed wings 96.2 fitted over the wings 88.2 of the first link, thereby also giving the second link a similar, generally U-shaped configuration. The wings 96.2 have respective aligned pivot pin holes therein at one end of the second link, these pivot pin holes being fitted over the pivot pin 90 for pivotally mounting the second link 96 on the first link 88. The wings 96.2 of the second link also have respective aligned pivot pin holes 96.4 therein at the opposite end of the second link. A cam follower roller 98 also preferably formed of a rigid brass material or the like is disposed between the wings 96.2 of the second link and a pivot pin 100 extends through the pivot pin holes 96.4 in the second link and through a corresponding central hole 98.1 in cam follower roller for rotatably mounting the roller on the second link, the opposite ends of the pin 100 being engaged with the principal walls of the casing sections 24 and 26 for retaining the pin for free rotation in the holes 96.4 and 98.1. In this arrangement the second link is proportioned for pivotal movement from a first position to a second position. In the first position of the second link, the cam follower roller 98 is engaged with the cam surface 92.3 on the first latch for manually holding the first latch 92 in a latching position thereof. A stop 88.5 on the first link is positioned adjacent the latch 92 in the latching position thereof as a limit to possible latch movement for a purpose to be noted below. In the second position of the second link, the cam follower roller 98 disengages the first latch cam surface permitting the first latch to rotate to an unlatching position thereof in response to the bias of the springs 84 which normally bias the contact arm 76 to the open circuit position of the circuit breaker. The roller 98 has substantial width engaging the cam surface 92.3 for minimizing roller wear. Further, because the roller 98 engages a cam surface 92.3 rather than a latching nose or the like, the latch and roller are not subject to excessive wear. The diameter of the roller 98 is significant in determining the force with which the roller bears against the cam surface 92.3 and accordingly, the roller diameter can be variably specified for varying the forces necessary to operate the breaker 10.

In the collapsible linkage 18 of this invention, the second link 96 is also provided with respective aligned slots 102 in the wings 96.2 of the second link, each of these slots having first and second portions 102.1 and 102.2 which are oriented at an angle relative to each other. A second latch member 104 constituting a latch pin is pivotally mounted within the slots 102 for movement between the two portions of the slots. That is, a pivot pin 106 is mounted for free rotation in pivot pin holes 88.6 in the first link so that the pin 106 is retained in those holes by positioning of the ends of the pin adjacent the principal walls of the casing sections 24 and 26. Keeper links 107 each have one end fitted over the respective ends of the pin 106 to extend between the wings 96.2 of the second link and have their opposite ends fitted over the second latch pin 104, the ends of the second latch pin being engaged with the walls of the casing section 24 and 26. Preferably, bushings 107.1 formed on the keeper links at said one end are also engaged with the walls of the casing sections 24 and 26 for assuring proper positioning of the keeper links. As the keeper links are subjected to only relatively light stresses, the keeper links are desirably molded of a synthetic plastic material such as glass-filled nylon or the like for achieving accurate construction at low cost. In this arrangement, the keeper links normally support the second latch pin in a latching position in the first position 102.1 of the slots in the second link, whereby the latch pin normally holds the second link in its first position with the cam follower roller 98 engaged with and holding the first latch 92 in the latching position of the first latch. However, the second latch pin 104 is adapted for pivotal movement as supported by the keeper links to move into the second portions 102.2 of the second link slots for permitting the second link to move to its second position and for permitting unlatching of the first latch 92.

Finally, the collapsible linkage 18 includes a tripping member 108 of a bell-crank shape which is mounted for pivotal movement on the first link 88 from a first position normally holding the second latch pin 104 in its latching position to a second position releasing the second latch pin for movement to its unlatching position when the tripping member is pivoted in response to application of an actuating force as is further discussed below. That is, the first link 88 has tripping member pivot pin holes 88.7 located in the first link wings 88.2 and a pivot pin 110 is extended through the holes 88.7 and through a corresponding pivot pin hole 108.1 in the tripping member so that the ends of the pin 110 are disposed adjacent respective wings 96.2 of the second link for retaining the pin 110 in such pivot pin holes between the wings 96.2. The tripping member 108 has a first arm 108.2 extending from a central bushing portion 108.3, the arm 108.2 having a latch surface 108.4 formed in one side of the arm for normally engaging and holding the second latch pin 104 in its latching position when the tripping member is in its first position. The tripping member 108 also has a second arm 108.5 angularly disposed relative to the first arm 108.2, the second arm having a clearance slot 108.6 fitted over the pivot pin 90 which mounts the first link and having an actuating nose 108.7 at the end of the second arm to be struck by the clapper for moving the tripping member to its second position. Preferably the tripper arm 108.2 has a pair of rod-like portions 108.8 extending laterally from respective opposite sides of the end of the arm 108.2 for use when the breaker is adapted for multipole application as described below.

A coil spring 112 fitted over the pivot pin 106 has one end 112.1 engaged with the first link 88 (or alternately with the second latch pin 104) while its opposite end 112.2 is engaged with the tripping member 108 for normally biasing the tripping member to its first position. The spring 112 is proportioned to provide only a relatively light biasing force to the tripping member.

In accordance with this invention, the dual-latch collapsible linkage system 18 of this invention incorporates components which are so proportioned relative to each other so that cumulative mechanical advantages are achieved, whereby the linkage 18 is adapted to move the movable contact arm 76 between open and colosed circuit positions with substantial force but whereby the linkage is adapted to be collapsed by the application of a relatively much smaller and consistently uniform force to the actuating nose 108.7 of the tripping member of the linkage. That is, the first latch and the first and second links are proportioned so that the force applied to the first latch by the contact arm tending to rotate the first latch in a clockwise direction (as viewed in FIG. 8) around the pin 94 has a relatively small moment arm as compared to the force applied to the first latch by the cam follower roller 98 which tends to rotate the first latch in a counterclockwise direction. Second, the cam follower roller, second link, second latch pin and keeper links are proportioned so that, although the first latch applies a significant force to the second link tending to rotate the second link to its second position around the pivot pin 90, that force has a very small moment arm relative to the pin 90 whereas the force exerted by the second latch pin 104 tending to restrain such rotation of the second link around the pin 90 has a greater moment arm. Further, because of the incline of the slots 102 in the second link, only a part of the force applied to the second latch pin by the second link tending to move the second latch pin is effective to move the second latch pin toward its unlatching position. Third, the second latch pin 104, the tripper 108 and the slots 102 in the second link are proportioned and located so that the force exerted on the tripper 108 by the second latch pin 104 is directed substantially in line with the pivot pin 110. As a result, that force has almost no moment arm tending to rotate the tripper in either direction around the pivot pin 110. However, the light frictional force between the latch surface 108.4 of the tripping member and the second latch pin 104 has a substantial moment arm relative to the pin 110 tending to restrain such clockwise rotation of the tripper member. Finally, the light frictional force between the latch surface 108.4 of tripping member and the second latch pin 104 has a moment arm relatively smaller than the moment arm of a force applied to the actuating nose 108.7 of the tripping member. According, the linkage 18 is adapted to hold the contact arm 76 in closed circuit position with a substantial force while only a relatively light, consistently uniform force need be applied to the actuating nose of the tripping member for initiating collapsing of the linkage 18.

In accordance with this invention, the tripper member 108 is desirably formed of precision molded thermoplastic or thermosetting high lubricity material for assuring that the tripping member is precisely proportioned at low cost, whereby the linkage 18 is adapted to be readily assembled with assurance that the linkage properly performs its functions as hereinafter described without requiring any cutting, bending or trimming of the linkage components as they are assembled together. For example, the tripping member 108 is desirably formed of a glass-reinforced thermoplastic polyester resin such as is sold by General Electric Company under the designation "Valox". Because the tripping member 108 is subjected to such low forces in the linkage 18 as above described, the latch surface 108.4, for example, of the member is not subject to cold flow or other detrimental variation in configuration even over a long service life. However, the tripper is readily formed of this material by molding so that the tripping member is precisely proportioned for easy assembly of the linkage. Further, because the tripping member is formed of a synthetic plastic material the tripper has high lubricity relative to the second latch pin 104 so that no initial lubrication of the linkage 18 is required during use of the circuit breaker 10. In addition, such tripper materials do not tend to be subject to corrosion even in hostile environments and do not tend to stick to metal members with which they are in pressure engagement. The tripper is also light in weight, and the engagement of the latch pin 104 with the tripper is in a direction transverse to the direction in which the weight of the tripper might tend to move the tripper. Accordingly, the linkage 18 is highly resistant to shock even though the linkage components have substantial mass and strength.

In the circuit breaker 10, the previously noted magnetic actuating coil 75 is preferably wound on a plastic spool 114 best seen in FIG. 9 which includes a hollow, tubular, central portion 114.1, a base 114.2 having a flange 114.3 which fits around the coil support arm 68.4 of the frame for properly positioning the spool on the frame, and a stop 114.4 at the opposite end of the spool engaging the frame 68 for properly mounting the coil 75 within the chamber 28. The spool 114 also preferably has a plurality of integral flexible fingers 114.5 extending upward from the spool and has a locating abutment 114.6 standing up from the top of the spool. A magnetic core means 116 for the actuating coil 75 has a central rod-like core portion 116.1 to fit within the coil 75, has a large cap or pole face 116.2 at one end of the central portion, and has a mounting flange element 116.3 at one end thereof. Preferably the mounting flange 116.3 is of generally rectangular shape as viewed along the axis of the core means and has key-slot aperture 116.4 receiving the cap 116.2 therein. In FIGS. 8-11, the core means 116 is illustrated as a solid core (such as would be normally used in instantaneous trip operation) for the actuating coil 75 so that the central portion 116.1 comprises a rod of annealed iron or the like. However, as is discussed further below, the core means could also be of the time delay type.

In accordance with this invention, the core means is mounted in the chamber 28 by disposing edges of the core mounting flange 116.3 in the recess 60 in the casing 24 and in a corresponding recess in the casing 26, by fitting the flange locating hole 116.5 over the locating abutment 114.6 on a coil spool to secure the cap 116.2 in the key slot, by extending the central core portion 116.1 through the spool 114, by disposing the end of the central core portion opposite the mounting flange into the recess 60.1 in the casing 24 and in a corresponding recess in the casing 26, and by engaging the core mounting flange 116.3 with the resilient fingers 114.5 on the spool for biasing the core to a consistent position in its mounting recess 60. In this arrangement, the coil 75 is easily and accurately mounted in the circuit breaker 10 and the core means 116 is also mounted with ease and accuracy relative to the coil, thereby to assure that the pole face 116.2 of the core means extends across a substantial part of the width of the housing chamber 28 and is accurately positioned in the chamber 28 relative to the pole face 68.2 of the magnetic frame in the chamber. The core and coil means are thus easily assembled without requiring that any soldering, welding or cold heading operations be performed at assembly. Accordingly, there is no risk that the core or the frame 68 will be subject to material stresses such as work-hardening such as might permit residual magnetism to build up in the core or frame during use of the circuit breaker 10. Further if disassembly of the breaker 10 is required for any reason, the coil, core and frame components of the breaker are easily recoverable without damage thereto for reuse if desired.

In the circuit breaker 10, a magnetic clapper 118 is also mounted on the casing sections 24 and 26 to be precisely located in the chamber 28 relative to the pole face 116.2 of the core, to the pole face 68.2 of the frame and to the actuating nose 108.7 of the tripper in the linkage 18. That is, the clapper 118 formed of a magnetically permeable metal material such as steel or iron has a generally flat, striplike configuration, has an actuating end 118.1 slightly inclined relative to the remainder of the clapper, has a pair of integral pintles 118.2 spaced a selected distance from the end 118.1 and a shorter distance from the opposite end of the clapper, has an integral biasing tab 118.3 struck up from the clapper intermediate the pintles and the inclined end 118.1, has an integral locating tang 118.4 struck down from the clapper adjacent the pintles between the pintles and the opposite end of the clapper, and having an additional deformation 118.5 at said opposite end of the clapper. A compact counterweight member 120 formed with a slot 120.1 therein is then press fitted over the deformed portion 118.5 of the clapper. The counterweight is preferably of a magnetically permeable material and of a configuration to depend downwardly alongside a portion of the coil 75 for a purpose to be discussed below.

In accordance with this invention, the clapper 118 is mounted in the circuit breaker 10 by disposing the pintles of the clapper so that one pintle fits against the locating abutments 62 and 62.1 in the casing section 24 and so that the other pintle fits against corresponding abutments in the casing section 26, the locating tank 118.4 of the clapper then being engaged behind the locating abutment 62.2 of the casing 24 and behind a corresponding abutment in the casing 26. In this arrangement, when a biasing spring 122 to be discussed further below is engaged with the clapper biasing tang 118.3, the clapper 118 is precisely mounted for pivotal movement in the chamber 28 between a rest position in which the clapper engages a stop 63 in the casing section 24 (see FIG. 7) and an actuating position wherein the clapper is engaged with the pole face 116.2 of the magnetic core means 116, with the pole face 68.2 of the magnetic frame, and with the actuating nose 108.7 of the tripper in the linkage 118. The clapper strip also extends across the full width of the chamber 28. The clapper weight is such that pivotal movement is substantially counterbalanced by the counterweight 120 and the clapper is normally biased to its rest position by the spring 122. The clapper shape is very simple so there is little tendency for damage or distortion to occur during annealing of the clapper and other clapper handling prior to assembly. However the clapper is adapted for precise pivotal movement on the knife edges formed by the edges of the clapper pintles adjacent to the locating tang 118.4 and is precisely located in the chamber 28.

In this arrangement of the actuator coil 75, the frame 68, the core means 116 and the clapper 118, a magnetic circuit is established from the frame 68 through the core means 116 to a portion of the clapper 118, and back to the frame through the frame pole face 68.2. In this magnetic circuit, the principal magnetic reluctance results from the air spacing of the clapper 118 from the pole face 116.2 of the core and from the pole face 68.2 of the frame. When electrical current flows in the coil 75 as hereinafter described, the magnetic field established by such current is directed through the noted magnetic circuit. In normal circuit breaker operation, such a magnetic field is insufficient to effect any movement of the clapper 118 against the bias of the spring 122. However, if a larger overload current is directed through the coil 75, the magnetic clapper 118 is magnetically drawn against the pole faces 68.2 and 116.2 for moving the clapper from its rest position to its actuating position. Of course, the proportions of the coil 75 are varied as desired to adapt the circuit breaker 10 for D.C. or 50, 60, or 400 hertz A.C., operation for operation in response to overload voltages in the breaker circuit. The cores 116 and springs 122 are also adapted to be readily changed for adjusting the circuit breaker operating ranges and the like.

The circuit breaker of this invention also includes a novel and improved calibration system 22 which is shown to include a calibrating member 124 preferably formed of a precision molded plastic material. The calibrating member has a first portion 124.1 adjacent one end which is mounted for free rotation in the opening 36 in the housing, a flange 124.2 to engage the casing section 24 and 26 for preventing axial sliding of the calibrating member in the opening 36 and an outer end flange 124.3 for substantially closing the housing opening 36, this outer flange having a slot or key recess in its outer surface for use in rotating the calibrating member as will be understood. The calibrating member also has an integral screw-threaded portion 124.4 which is freely rotatable in the recess 66 in the casing section 24 with the remainder of the calibrating member and has a reduced diameter portion 124.5 of its opposite end fitted into the casing recess 66.1 for permitting rotation of the member while retaining its axial alignment in the casing recess 66. The casing section 26 is fitted over the recesses 66 and 66.1 for retaining the calibrating member therein. The spring 122 preferably comprises a coil tension spring having a convolution 122.1 at one end fitted over the biasing 118.3 of the clapper and having a convolution at its opposite end fitted over the screw-threaded portion of the calibrating member and threadedly engaged with that portion of the member in the manner of a one-thread nut, thereby to apply a biasing force to the clapper tending to hold the clapper in its rest position. The calibrating member 124 is located on the housing 12 so that rotation of the calibrating member is adapted to threadedly advance the spring end 122.2 along the threaded portion 124.4, thereby to vary the direction in which the force of the spring 122 is applied to the clapper without substantially altering the tension to which the spring is subjected. In this way the noted movement of the spring 122 changes the moment arm (relative to the pintles of the clapper) with which the spring biasing force is applied to the clapper for changing the level of force holding the clapper in its rest position thereby to calibrate the circuit breaker 10. To allow use of a low rate spring for limiting buildup of clapper bias during clapper rotation to achieve snappier clapper action, the spring preferably has an initial tension so that adequate bias force is obtained with minimum spring extension, thereby saving spring space.

The circuit breaker is easily calibrated by rotation of the member 124 which is conveniently accessible from outside the breaker on the top surface of the breaker adjacent the operating handle 14. The calibration system is very compact and is therefore easily located in this desirably accessible position in the breaker. As the member 124 does not move axially during calibration, the member remains accessible as it is rotated and is therefore amenable to automated calibration. The spring 122 does not tend to cause rotation of the calibration member 124 so that when adjustment is made, there is no backlash in the adjustment and no locking means is required for holding the calibrating member in its position of adjustment during use of the circuit breaker. Where desired, a drop of glyptal is applied over the housing opening 36 after calibration to deter tampering with the calibration setting. Further, the calibrating member has a substantial number of fine screw threads so that many revolutions of the calibrating member are required to adjust the calibration throughout its desired range. Thus, high resolution calibration of the breaker is achieved. Also, when the spring end 122.2 has been advanced to one end or the other of the screw threaded portion of the calibrating member, the spring end 122.2 merely slips if the calibrating member is further rotated. Thus, there is no risk that calibration can result in damage to the calibration system if excessive rotation of the calibrating member is attempted Further, because the stress on the spring 122 is not substantially changed during adjustment or calibration of the breaker, the spring rate of the spring need not be precisely controlled while still permitting achievement of excellent breaker calibration. Further, because the spring is a tension spring, there is no tendency for spring convolutions to bind against each other to cause errors in the calibration. The spring 122 is preferably provided with a relatively low spring rate so that when the clapper 118 is moved to its actuating position as described below, the spring 122 does not apply any significantly greater torque to the clapper such as might reduce the effectie clapper force at the moment the clapper strikes the actuating nose of the tripper 108.

The circuit breaker 10 is adapted to achieve consistently, uniform operation as is hereinafter described. That is, with the circuit breaker 10 in a closed circuit position as illustrated in FIG. 8, a circuit extends from the load terminal 51, through the coil 75 to the fixed contact 72 carried by the terminal 52, through the contacts 78 and 80, the bifurcated ends 76.1 and 76.2, and the intermediate portion 76.4 of the movable contact arm to the fixed contact 74 carried by the terminal 50. If desired for connecting the breaker 10 for conventional shunt trip operation, exterior electrical connection can be made to the terminal 52. The movable contact arm 76 is normally held in its closed circuit position bridging the contacts 72 and 74 as shown in FIG. 8 by disposition of the operating handle 14 in its closed circuit position to hold the collapsible linkage in an overcenter position. That is, when the position shown in FIG. 8, the pivot pin 90 is disposed to the right of a line between the pivot pin 94 and the pivot pin means 14.6 on the operating handle under bias from the contact arm spring 84. The first latch 92 is normally held in its latching position by engagement of the cam follower roller 98 with the cam surface 92.3 of the first latch. The second link 96 is normally restrained in its first position holding the roller 98 engaged with the cam surface 92.3 by the engagement of the second latch pin 104 in the slots 102 of the second link. The second latch pin is held in its latching position by the tripper 108. The arm 108.5 of the tripper is disposed in the clearance slot 68.3 of the frame with the actuating nose 108.7 positioned a precise distance above the pole face 68.2 of the frame. The clapper 118 is disposed in its rest position under a predetermined bias as determined by the adjustment of the calibration system 22. In this situation, normal current flows in the noted breaker circuit.

If manual opening of the breaker circuit is desired, the operating handle 14 is manually moved to its open circuit position moving the pivot pin 90 through an overcenter position to the left of the line between the pivot pin 94 and the pivot pin means 14.6 on the operating handle. As the pivot pin moves across that noted line, restraint of the movable contact arm 76 is released and the arm moves to its open circuit position under the bias of the spring 84, thereby moving the linkage 18 to the position shown in FIG. 10. As initial circuit opening movement of the contact arm 76 occurs, when arcing between the mating contact pairs 72–78 may occur, the magnetic field established around the terminals 50 and 52 and around the bifurcated ends of the contact arm by the current still flowing in the breaker circuit, keeps the noted arcs separated from each other and deflects the arcs away from the contact arm to be vented from the breaker and extinguished as the arcs pass through the gridded aperture in the arc chute member. During such manual opening of the breaker circuit, the first latch 92, the second latch pin 104 and the tripping member 108 generally remain in their positions relative to each other as illustrated in FIG. 8.

Figure 11:
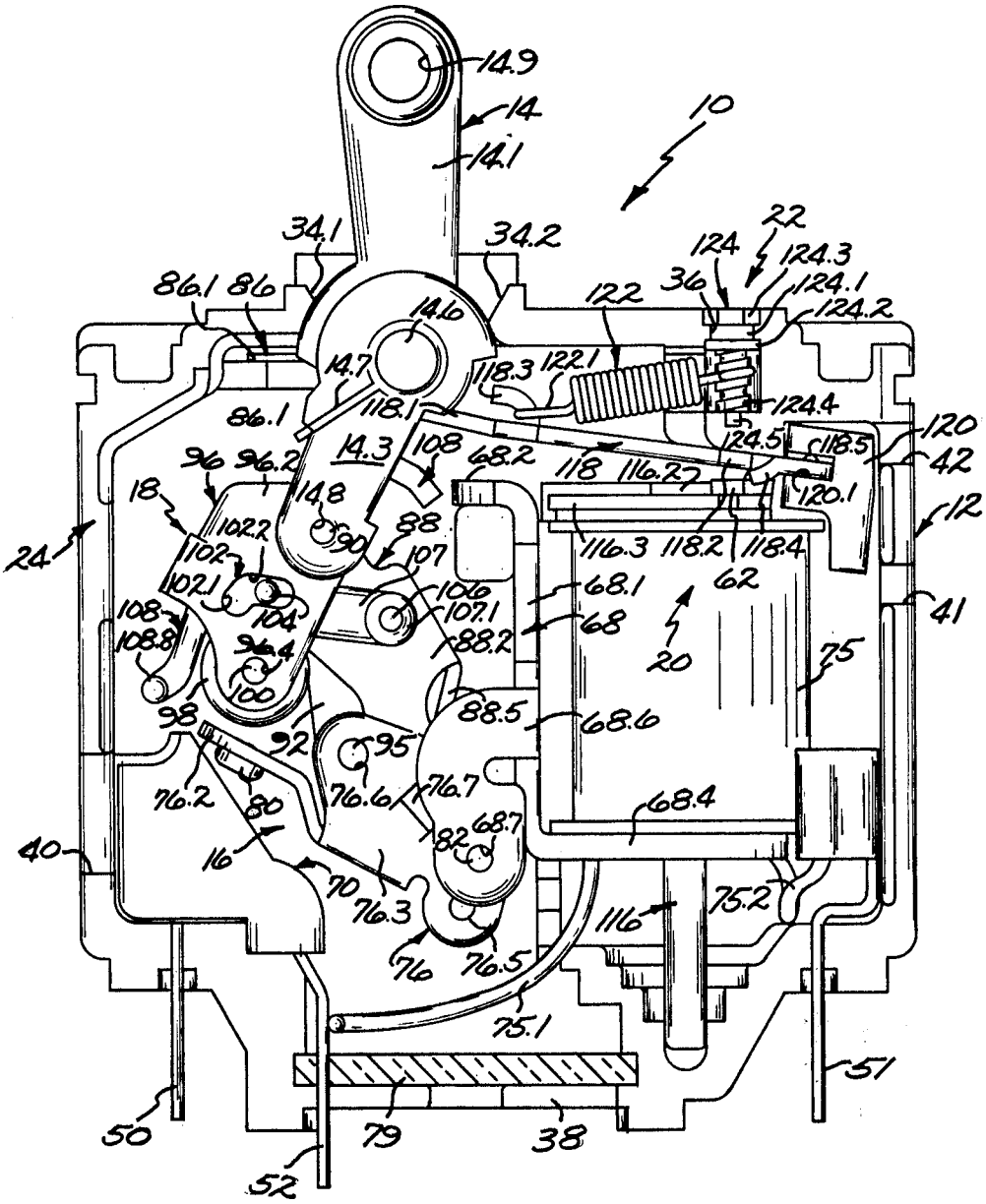
FIG. 11 is a section view similar to FIG. 8 showing the movable circuit breaker components as the circuit breaker is inititing movement to open circuit position on the occurrence of an overload in the breaker circuit.

However, if an overload current occurs in the breaker circuit, the magnetic field established by the flow of such overload current is directed through the main magnetic circuit of the breaker as previously described. The clapper 118 then moves sharply from its rest position (see FIG. 8) to its actuating position, thereby striking the actuating nose 108.7 of the tripper of the linkage 18 to initiate collapsing of the linkage. That is, the tripper 108 is rotated to its second position on the pin 110 for releasing the second latch pin 104. The second latch pin moves in the slots 102 in the second link permitting the second link to ride off the cam surface of the first latch 92 for permitting the first latch to rotate under bias of the spring 84 and for permitting the movable contact arm 76 to move sharply to its open circuit position as the collapsing of the linkage 18 occurs. A position of the circuit breaker components at this collapsing of the linkage occurs is illustrated in FIG. 11. Subsequently, the operating handle 14 then moves to its open circuit position under the bias of its spring 86, this movement of the operating handle further moving the linkage to the position shown in FIG. 10 wherein the tripper, the second latch pin, and the first latch are returned to their latching positions for resetting the circuit breaker to permit manual reclosing of the circuit breaker. The stop 88.5 on the first link 88 assures that the first latch 92 is properly positioned for such resetting by limiting counterclockwise rotation of the first latch. The movement of the linkage to its rest position snaps the tripper against the clapper 118 to assure that the clapper is returned to its rest position and does not tend to stick to the magnet pole faces 68.2 and 116.2 due to any residual magnetism. If manual reclosing of the circuit breaker is attempted while the overcurrent condition still exists in the circuit monitored by the breaker, reclosing of the breaker contacts results in immediate movement of the clapper 118 to cause collapse of the linkage 18 and reopening of the breaker circuit. Thus the breaker displays trip-free operation and cannot be held in closed circuit position while such an overcurrent condition continues.

It should be noted that, when the operating handle 14 is manually moved to its open circuit position while the clapper 118 is in its rest position, the clapper fits into the clearance space 14.4 in the operating handle. In this clapper position, the tripper nose 108.7 is positioned to interface with the extending end of the clapper portion 118.1 for blocking any possible movement of the clapper against the pole faces of the frame and core means. Accordingly, the clapper is not thereafter movable to its actuating position even when an overload current should be direct through the coil 75 between the terminals 51 and 52. This feature of the circuit breaker 10, referred to as "clapper blocking", facilitates testing and some forms of calibration of the circuit breaker wherein it is desired to direct selected current levels through the coils in an automated testing operation without requiring resetting of the circuit breaker after each such test. For example, such clapper blocking permits the core rod in a time delay core means to be positioned at the internal core pole face by applying an overload current to the coil, thereby to permit subsequent device calibrating adjustment without requiring any manual blocking of the clapper. However, test openings 42 are also provided in the breaker housing for permitting manual movement or blocking of the clapper 118 where that should be desired.

Figure 14:
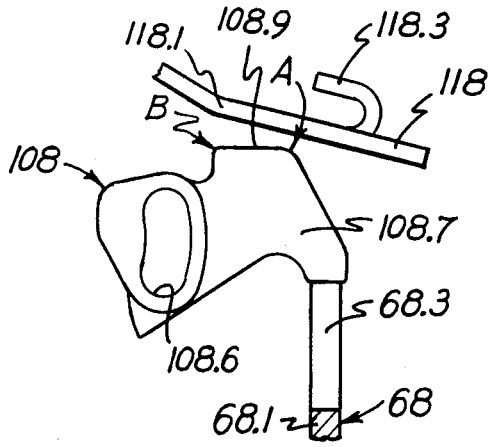
FIG. 14 is a partial side elevation view similar to FIG. 8 illustrating tripping motion of the circuit breaker of FIG. 1 is response to an overload condition in the breaker circuit.
Figure 15:
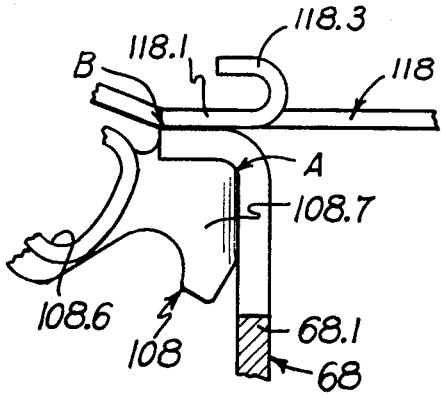
FIG. 15 is a partial side elevation view similar to FIG. 14 illustrating a subsequent stage in the tripping motion of the circuit breaker of FIG. 1 in response to an overload condition of the breaker circuit.

It should also be noted that the circuit breaker 10 provides a novel and improved arrangement of the clapper 18 relative to the frame pole face 68.2 and to the actuating nose 108.7 of the linkage tripper. In this regard it will be understood that, as the clapper 118 is magnetically moved from its rest position to its actuating position the magnetic field causing this movement is progressively increased in strength as the clapper approaches the pole face 68.2 and as the magnetic reluctance caused by the spacing of the clapper from that pole face is progressively decreased. Accordingly, the clapper is desirably adapted to strike the actuating nose 108.7 very close to the plane of the pole face 68.2 when the clapper force is large to assure that tripper movement is initiated. On the other hand, it is desirable that, after the clapper initially strikes the actuating nose, the clapper be subjected to additional movement of significant length to assure that the rotation of the tripper resulting from additional clapper movement is sufficient to assure proper tripping of the linkage 18. In previously known circuit breakers, the spacing of the clapper relative to the actuating nose of the tripper had been a source of considerable difficulty during assembly in attempting to achieve the proper compromise between these two conflicting considerations. This problem has also resulted in many malfunctions during use where the clapper might strike the tripper with inadequate force to move the tripper or where the clapper travel after impact with the tripper was ineffective to initiate opening of the breaker circuit. In the circuit breaker 10, the actuating nose 108.7 is provided with an actuating cam surface 108.9 which in inclined relative to the surface of the clapper adapted to engage that surface, whereby the point of initial engagement of the clapper with the nose occurs at cam surface portion A on the surface 108.9 as illustrated in FIG. 14 thereby to assure that the clapper is close enough to the pole face 68.2 to have the desired impact force on the tripper. However, as the tripper rotation occurs, the point of engagement between the clapper and the tripper surface moves along surface 108.9 to the cam riser surface portion B as illustrated in FIG. 15, thereby to provide a relatively greater stroke or travel of the tripper to assure that the tripper rotation is adequate to initiate opening of the breaker circuit.

The circuit breaker 10 as above described is also characterized by a modular construction which facilitates low cost adaptation of the breaker for other types of current breaker applications such as are shown in FIGS. 16-26 which illustrate other, alternate preferred embodiments of the circuit breaker of this invention. Where components of these other alternate embodiments of the invention incorporate components corresponding to those illustrated and described above with reference to the circuit breaker 10, those components are indicated by corresponding numerals.

Figure 16:
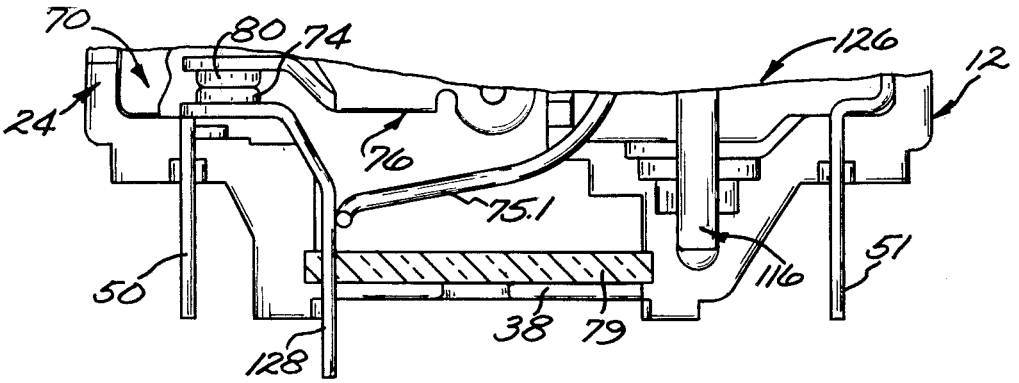
FIG. 16 is a partial section view similar to FIG. 8 illustrating an embodiment of the circuit breaker of FIG. 1 adapted for relay trip operation.

For example, in an alternative preferred embodiment of the circuit breaker of this invention as indicated at 126 in FIG. 16 the circuit breaker is adapted for series trip operation by substituting a shorter stub terminal 128 for the terminal 52, the terminal 28 having the fixed contact 78 mounted thereon but being relatively shorter than the terminal 52 so it does not extend as far through the bottom opening 38 in the housing 12. The stub terminal is still accessible for use if testing of the coil 75 should be required or if a group of breakers are to be connected with the coils alone arranged in series for calibration.

Figure 17:
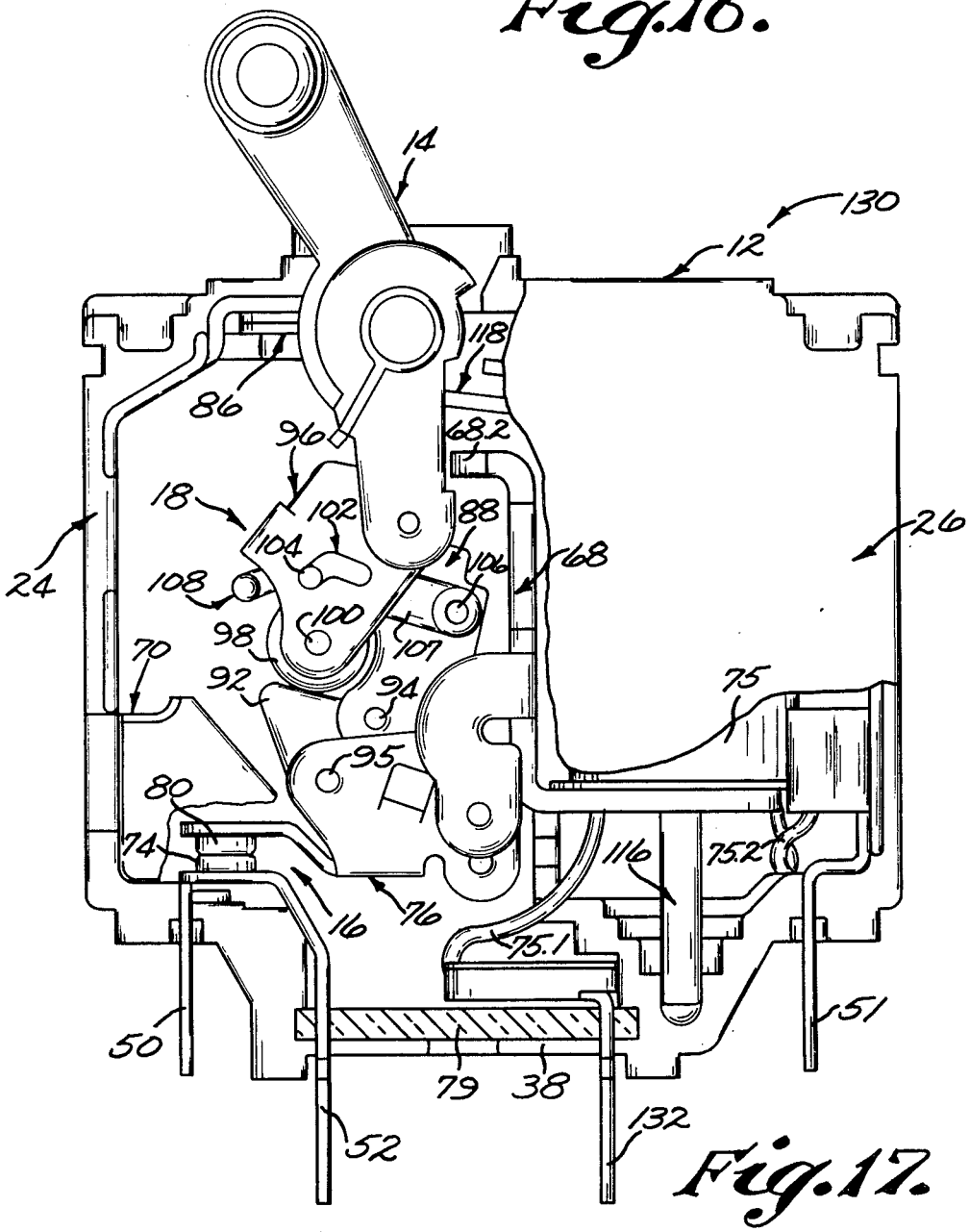
FIG. 17 is a partial section view similar to FIG. 8 illustrating an embodiment of the circuit breaker of FIG. 1 adapted for series-trip operation.

In another alternate embodiment of this invention indicated at 130 in FIG. 17, a terminal 132 is mounted in the housing openin 38 in addition to the terminal 52 used in the circuit breaker 10, the terminal 132 (instead of the terminal 52) being electrically connected to the coil end 75.2 within the circuit breaker for adapting the breaker for conventional relay-trip type of circuit breaker operation.

Figure 18:
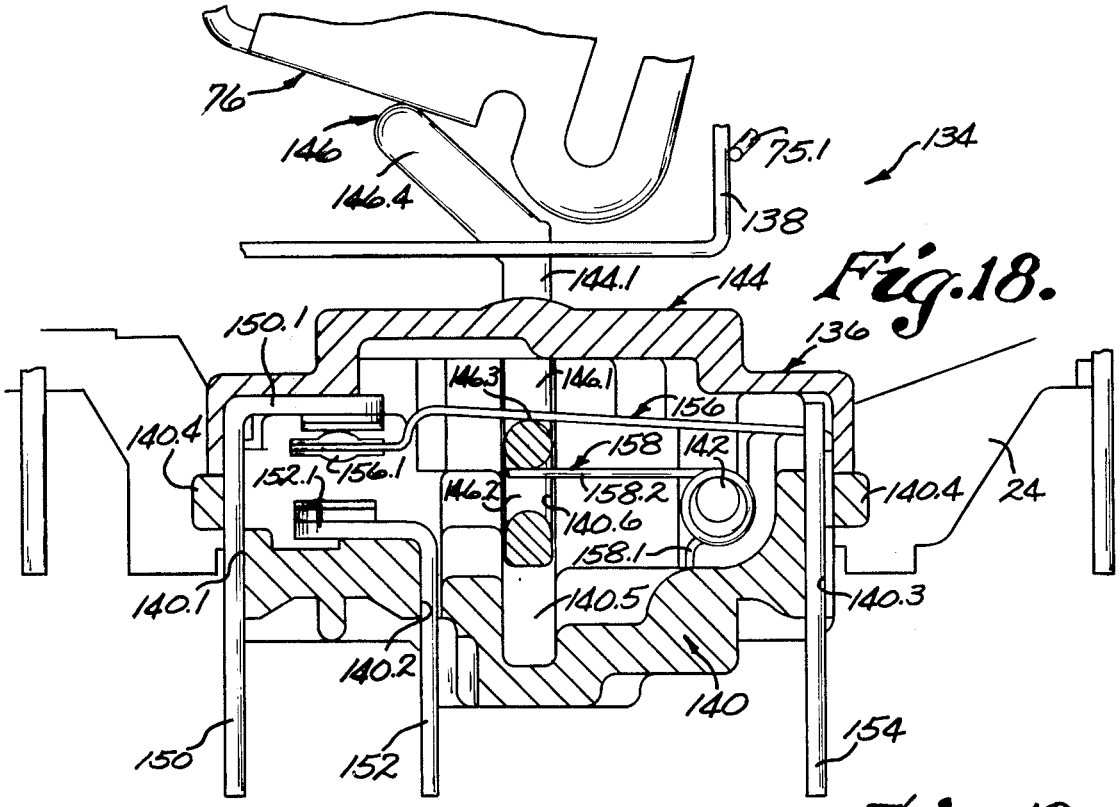
FIG. 18 is a partial section view similar to FIG. 8 illustrating an embodiment of the circuit breaker of FIG. 1 adapted for operation with an auxiliary switch illustrating the circuit breaker in open circuit position.
Figure 19:
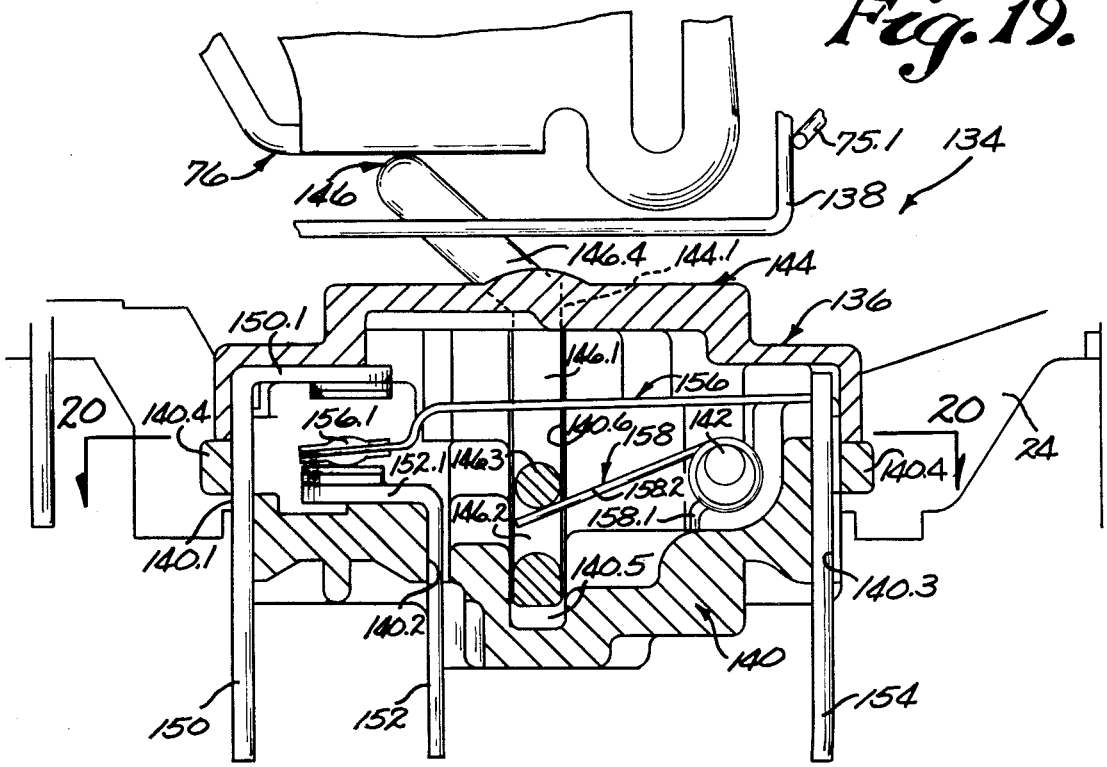
FIG. 19 is a partial section view similar to FIG. 18 illustrating the circuit breaker with an auxiliary switch and with the circuit breaker in closed circuit position.
Figure 20:
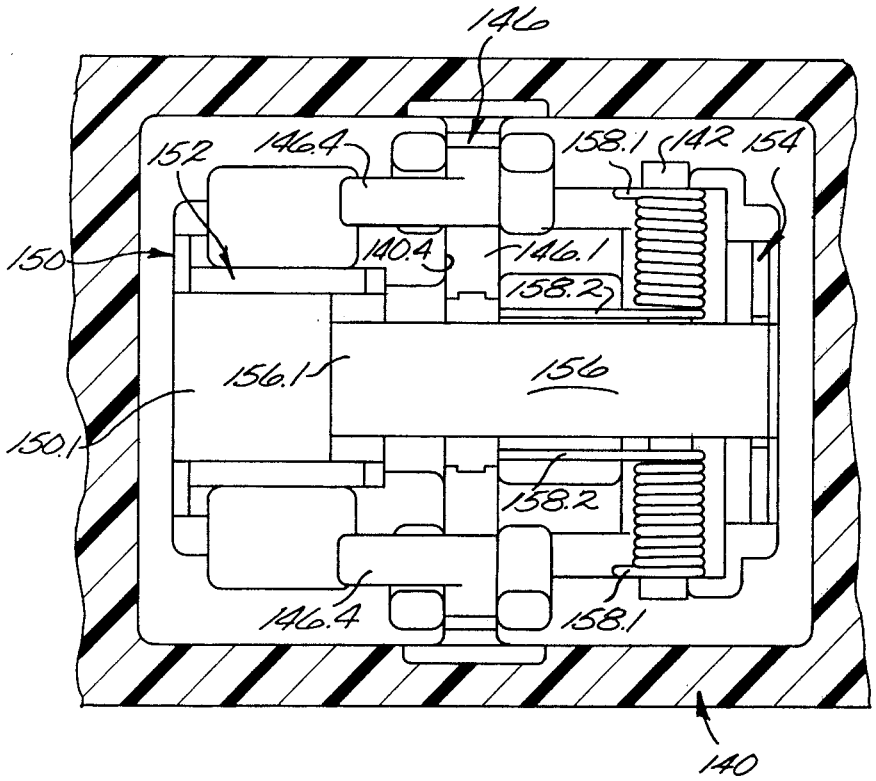
FIG. 20 is a section view along line 20—20 of FIG. 19.

In another alternate embodiment of this invention indicated at 134 in FIGS. 18-20, the circuit breaker is adapted for auxiliary switch type of circuit breaker operation. In this embodiment of the invention, the breaker incorporates a novel and improved auxiliary switch structure indicated generally at 136 which is adapted for easy assembly within the circuit breaker and which is adapted to be operated as a single pole double throw switch without subjecting the other circuit breaker components to such forces as would interfere with proper operation of the circuit breaker. In this embodiment of the invention, a terminal 138 is substituted in the housing 12 for the terminal 52, the content 72 and the actuator coil end 75.1 being connected to the terminal 138. The configuration of terminal 138 thus frees the housing opening 38 to accommodate the switch 136; the cover 77 is omitted from the opening 38; and casing recesses 138.1 and 138.2 (see FIG. 7) receive corresponding tangs on the terminal 138 to assist in locating the terminal 138 in the housing 12.

The auxiliary switch 136 comprises a bottom casing section 140 of a dielectric material which has terminal openings 140.1, 140.2 and 140.3 therein, has a flange 140.4 fitted into recesses 64 in the casing section 24 and in a corresponding recess in casing 26 for mounting the switch on the housing 12, has guide grooves 140.6 therein, has an overtravel guide groove portion 140.5, and has a pin 142 mounted on the casing section 140. Terminals 150, 152 and 154 are mounted in the respective openings in the bottom casing section and have mounting tabs crimped to the bottom casing section. A resilient, conductive contact arm 156 is secured to the terminal 154 to extend in cantilever relation therefrom and carries contct means 156.1 at its distal end for movement between respective positions engaging contacts on terminal ends 150.1 and 152.1 for closing alternate circuits between terminals 152-154 and terminals 150-154. An actuator 146 has a main portion 146.1 slidable in the casing guide groove 140.6, has an opening 146.2, has an abutment 146.3 engaged with the contact arm 156, and has a pair of spaced portions 146.4 extending from the casing section 140 to engage the movable circuit breaker arm 76. A pair of springs 158 are fitted over the pin 142, each having one spring end 158.1 abutting the casing 140 and the opposite spring end 158.2 fitted into the actuator opening 146.2 normally biasing the actuator to the position shown in FIG. 18. A cover 144 is preferably positioned over the top of the casing 140 and is fitted between the actuator portion 146.4 to be held in place by engagement with abutment 144.1 on the circuit breaker casing sections 24 and 26.

In operation of the auxiliary switch 136, the actuator 146 is normally held in the position shown in FIG. 19 by engagement with the circuit breaker contact arm 76 when the circuit breaker is in closed circuit position, the actuator being held in this position against the bias of the springs 158 so that the switch contact arm engages the contact means 156.1 with the terminal end 152.1 to close a first switch circuit between terminals 152 and 154. In this circuit position the pressure engagement between the contact means 156.1 and the terminal end 152.1 is determined by the resilience of the contact arm 156. When the circuit breaker contact arm 76 is moved manually or automatically to open circuit position, the actuator 146 is moved to the position shown in FIG. 18 in response to bias of the springs 158, the movement of the actuator moving the switch arm 156 the engage the contact means 156.1 with the terminal end 150.1, thereby to open the first switch circuit and to close a second switch circuit between terminals 150 and 154.

In this arrangement, the switch contact arm 156 is provided with only the degree of resilience necessary to achieve the desired contact pressure between the contact means 156.1 and the terminal end 152.1. Accordingly, substantially all of the force applied to the circuit breaker contact arm 76 by the switch 136 results from the bias of the springs 158 even as the switch 136 is moved through its two contact positions. For example, even where the circuit breaker contact arm 76 is subjected to overtravel during closing of the breaker circuit as a result of the resilient mounting of that arm and as a result of movement of the breaker linkage 18 through an overcenter position, the actuator 146 easily slides into the overtravel portion 140.5 of the guide grooves in the bottom casing section and the principal switch force resisting such overtravel of the contact arm 76 results from the bias of the springs 158 which preferably have a low spring rate and a precisely predetermined torque output. The fact that the switch arm 156 changes from a simple cantilever beam to a propped cantilever beam during such overtravel after the arm engages the terminal end 152.1 does not result in several fold increase in the forces applied to the circuit breaker arm 76 as occurred in previously known auxiliary switch arrangements. That is, since the arm 156 no longer bears against the actuator 146 after the arm 156 engages the terminal 152.1, the circuit breaker 135 operates in a consistent manner regardless of the circuit position of the auxiliary switch and is not subject to such high and varying forces by the switch as might create undesirable variations in circuit breaker operation due to excessivve loading of the latches in the linkage 18. The switch 136 is also adapted to be assembled and tested before mounting in the breaker 135. If desired, the springs 84 may be changed to provide a different bias to the arm 76 where the auxiliary switch 136 is used.

In another preferred embodiment 160 of the circuit breaker of this invention as illustrated in FIG. 21, the circuit breaker is adapted for flux switch type of circuit breaker operation so that the circuit breaker is adapted for use where high but brief transient current overloads are likely to occur and where it is desired that the circuit breaker tolerate such brief transients without nuisance tripping. In the circuit breaker 160, the instantaneously operating type of magnetic core means 116 used in the circuit breaker 10 is preferably replaced with a time-delay type of magnetic core means 162 as shown in FIG. 21. In the time-delay core means a core member 162.1 of annealed steel is slidably mounted in an open ended tube 162.2 of non-magnetic brass or the like and is biased to one end of the tube by a coil spring 162.3, the tube being otherwise filled with a liquid 162.4 and having its open end sealed with a cap 162.5 of magnetically permeable material swaged to the tube. When such a time-delay core means is disposed inside a magnetic actuator coil with the cap end of the core means disposed adjacent a magnetic clapper to correspond to the pole face 116 of the core means shown in the circuit breaker 10, the occurrence of an overload current in the coil establishes a magnetic field which tends to draw the core 162.1 to the cap end of the core means against the bias of the spring 162.3, the movement of the core to the cap end being delayed in the manner of a dash-pot by the liquid 162.4 in the core means. When such a time-delay core means is used, the magnetic circuit partially formed by the core means has a large initial reluctance resulting from the large initial spacing of the core 162.1 from the internal end of the cap 162.5. The clapper is therefore moved to its circuit breaker actuating position only with a time delay after the occurrence of the noted circuit overload when the core 162.1 has moved to the cap end of the core means. As the above-noted structural features and method of operation of a time-delay core means are conventional and are shown in U.S. Pat. No. 3,900,810 for example, those features are not further described and it will be understood that the time-delay core means 162 is adapted to function in a conventional mannner. In accordance with this invention, however, the core means 162 further includes a flange plate 162.6 secured to the cap 162.5, the flange plate having a generally rectangular configuration as viewed axially along the core means and having an aperture 162.7 therein. Preferably the plate 162.6 has another aperture therein and the cap 162.5 is fitted through the plate aperture and is swaged to the tube 162.6 for securing the flange plate to the cap 162.5. In the circuit breaker 160, the core means 162 is then mounted in the circuit breaker by disposing the edges of the flange plate 162.6 in the recess 60 of the casing section 24 and in a corresponding recess in the casing 26 and by fitting the aperture 162.7 over the locating abutment 114.6 on the coil mounting spool, thereby to mount the core means 162 in the manner of the core means 116 shown in the circuit breaker 10.

In the circuit breaker 160, an auxiliary flame or flux guiding magnetic circuit segment member 164 is also utilized, the flux member having an apertured base part 164.1 thereon, having base flange portions 164.2 and 164.3 which fit into recesses 164.4 and 164.5 in the casing section 24 (see FIG. 7) and in corresponding recesses in the casing 26, and having an arm 164.6 which extends alongside the coil 75 so that the distal end of the arm is spaced closely adjacent to depending counterweight 120 on the clapper 118. As previously noted, the counterweight 120 is preferably of magnetically permeable material. Desirably, an electrically insulating sleeve (not shown) is fitted over the arm 164.6 to avoid any contact between the arm 164.6 and the end 75.1 of the actuating coil or the terminal 51.

In this arrangement of the flux type circuit breaker 160, the circuit breaker has a main magnetic circuit extending from the frame 68, through the core 162.1 and a portion of the clapper 118 to the frame pole 68.2, the principal magnetic circuit resulting from the spacing of the clapper 118 from the pole face 68.2 and the cap 162.5 and the spacing of the core 162.1 from the internal side of the cap 162.5. The circuit breaker also has an auxiliary magnetic circuit extending from the auxiliary frame or flux member arm 164.6, through the core 162.1, through portions of the clapper 118 and through the counterweight 120 back to the member arm 164.6. The principal reluctances in this auxiliary magnetic circuit result from the spacing of the counterweight 120 on the clapper 118 from the auxiliary frame arm 164.6 and from the cap 162.5 of the core means and the spacing of the core member 162.1 from the internal side of the cap 162.5. If the core member 162.1 is in the down position shown in FIG. 21 when an overload current occurs in the coil 75, the auxiliary magnetic circuit initially receives a significant share of the magnetic flux produced by the overload current. The flux of the main magnetic circuit initially tends to draw core 162.1 toward the cap end of the core means and tends to draw the clapper 118 into the engagement with the pole face 86.2 on the frame. However, the flux initially occurring in the auxiliary magnetic circuit tends to resist any such movement of the clapper 118. Thus, movement of the clapper in response to the main magnetic circuit is initially resisted both by the calibrating spring 122 and by a reverse torque applied by the auxiliary magnetic circuit so that clapper movement does not occur and the circuit breaker is not tripped by a brief transient overload current. Thus the circuit breaker 160 displays improved resistance to nuisance tripping in response to the occurrence of even very high transient current overloads, such breakers being adapted to withstand transients of 25–30 times the breaker rating where the transient duration is on the order of a few milliseconds.

However, if the overload current condition continues so that the core 162.1 is moved toward the cap end of the core means, this core movement changes the spacing between the core 162.1 and the cap 162.5 which is common to both magnetic circuits. This change of spacing decreases the reluctance in the main magnetic circuit but does not decrease the reluctance of the auxiliary magnetic circuit to the same extent. That is, the core movement in moving the bottom end of the core 162.1 away from the flux member 164 tends to provide an increasing spacing between the core and the flux member which maintains the reluctance of the auxiliary circuit at a relatively constant level. Accordingly, movement of the clapper occurs only when movement of the core changes the reluctance of the main magnetic circuit to the point where the torque force applied to the clapper by the main magnetic circuit overcomes the retarding force of the spring 122 and of the auxiliary magnetic circuit. However, once clapper movement is initiated, the reluctance of the main magnetic circuit decreases as the clapper movement reduces its spacing relative to the pole face 68.2 while the reluctance of the auxiliary magnetic circuit begins to increase as the counterweight 120 moves away from the flux member arm 164.6. In this way the change in forces on the clapper has an avalanche effect providing especially sharp movement of the clapper to its actuating position. In this way, the circuit breaker achieves not only increased resistance to nuisance tripping in response to brief transient current overloads but also achieves sharper clapper movement for improved circuit breaker tripping when the overload current continus for a longer period of time.

Figure 23:
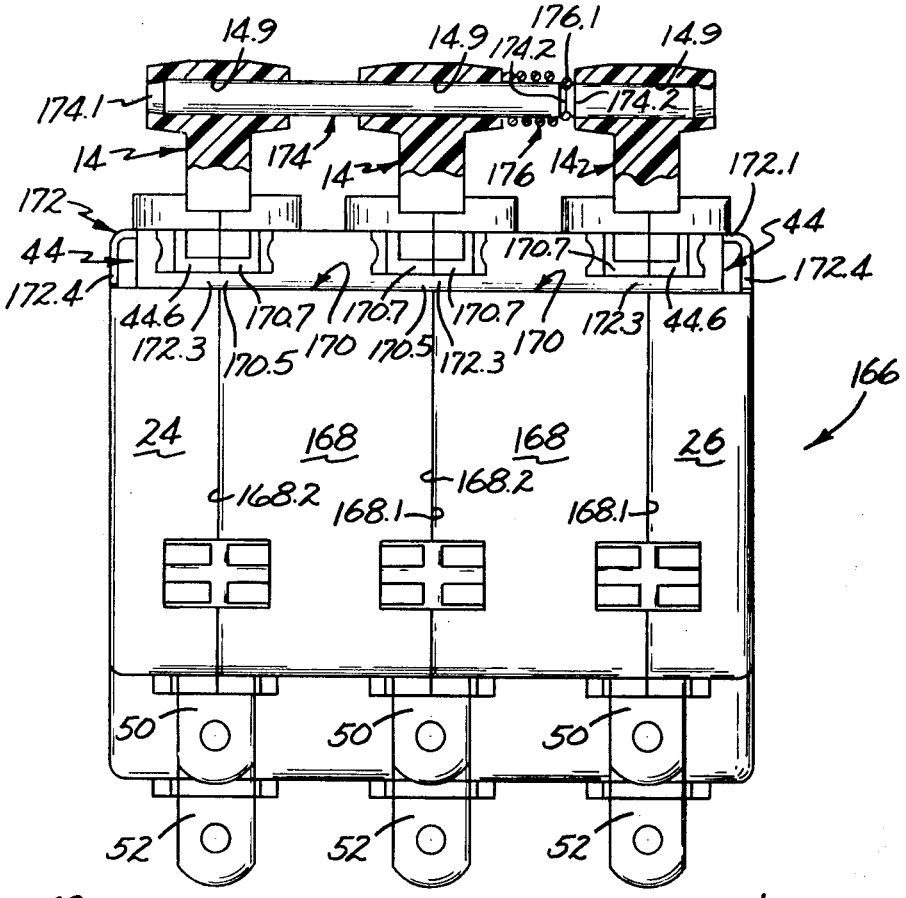
FIG. 23 is a section view along line 23—23 of FIG. 22.
Figure 24:
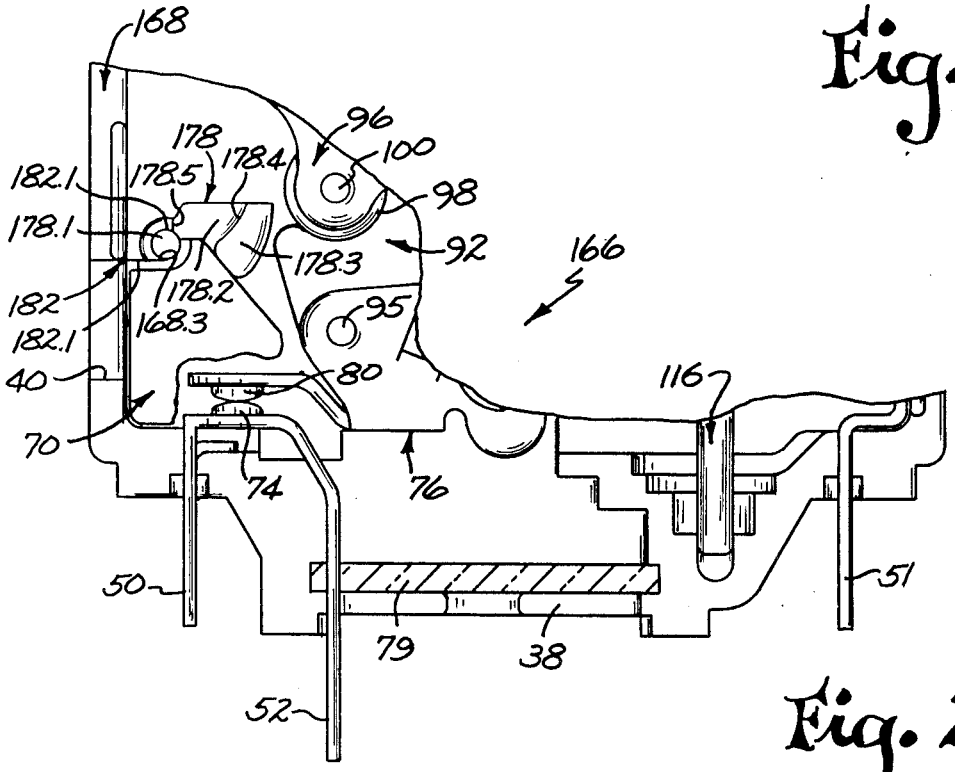
FIG. 24 is a partial section view along line 24–24 of FIG. 22 illustrating the multipole circuit breaker of this invention in closed circuit position.
Figure 25:
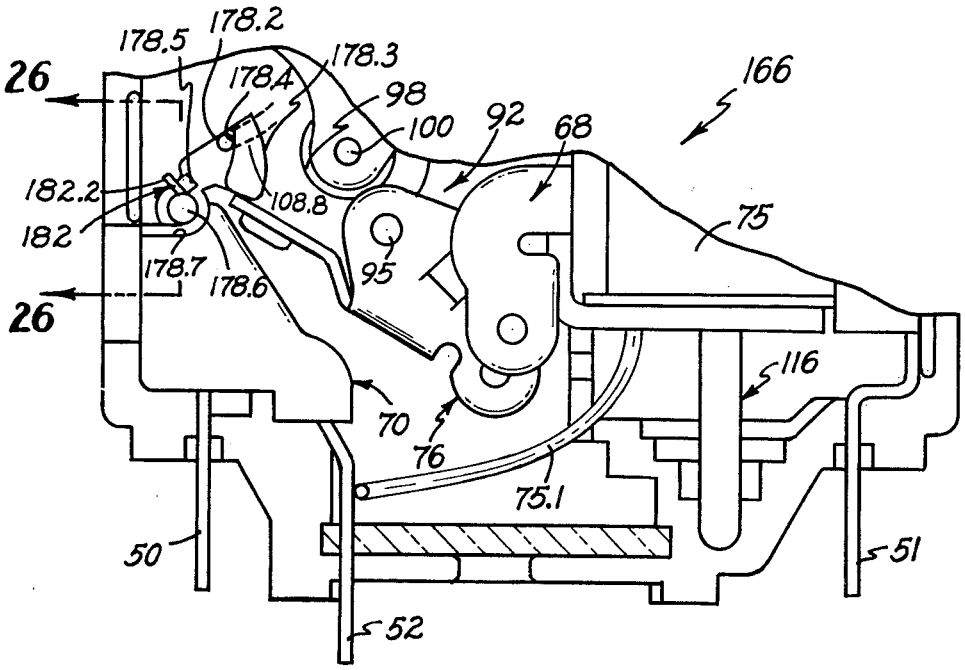
FIG. 25 is a section view similar to FIG. 24 illustrating movement of various multipole actuators in response to opening of one pole of the mulipole circuit breaker on occurrence of an overload condition in that pole of the circuit breaker.

In another alternate embodiment 166 of the circuit breaker of this invention as illustrated in FIGS. 22–26, breaker 10 is adapted for multipole application. A double-sided casing section 168 is utilized between each pair of adjacent poles of the multipole breaker, one side 168.1 of the casing section having edge walls and interior casing features corresponding to those provided on the casing section 24 as previously described and the other side 168.2 of the casing section having edge walls and interior casing features corresponding to those provided in the previously described casing section 26. One or more of the casing sections 168 are then fitted together with each other, and with one each of the casing sections 24 and 26 as shown in FIGS. 22, 23 and 25, to form a housing defining a plurality of chambers 28 within the breaker 166. The single housing section 168 is readily combined with the single pole section 24 and 26 to build up any desired multipole device in a compact and efficient manner. The exterior surfaces of the casing sections 168 have recess configurations 170 thereon (corresponding to the recess configurations 44 in the casing sections 24 and 26) providing the exterior of the casing section 168 with a pair of clearance recesses 170.2 and with slots 170.5 forming a pair of detent abutments 170.7 corresponding to similar features on the exterior of the casing sections 24 and 26. A pair of metal mounting clips 172 are disposed on the housing of the breaker 166 to fit into the recess configurations 170 on the casing section 168 and into recess configurations 44 on the casing sections 24 and 26, the clips each having a top sheet portion 172.1 with a cam slot 172.2 therein, having a plurality of detent portions 172.3, and having a pair of guide portions 172.4 corresponding to similar features on the previously described mounting clip 46, whereby the edges of the cam slot 172.2 engage the clamping cam surfaces of the casing sections 24 and 26 and shown in FIG. 22 for holding the casing sections 24, 26 and 168 together to form the housing for the circuit breaker 166, whereby each of the detent portions 172.3 fit over respective pairs of the detent abutments 44.6 or 170.7 on the casing sections, and whereby locking tabs on the guide portions 172.4 of the clips fit into locking slots in the casing sections 24 and 26 for securing the clips 172 on the breaker housing. In this arrangement no metal rivets such as might cause arcing or breakdown between poles extend through the housing sections. The clips 172 are each preferably provided with a plurality of tapped holes 172.5 for use in mounting the multipole circuit breaker 166 on a control panel.

Figure 26:
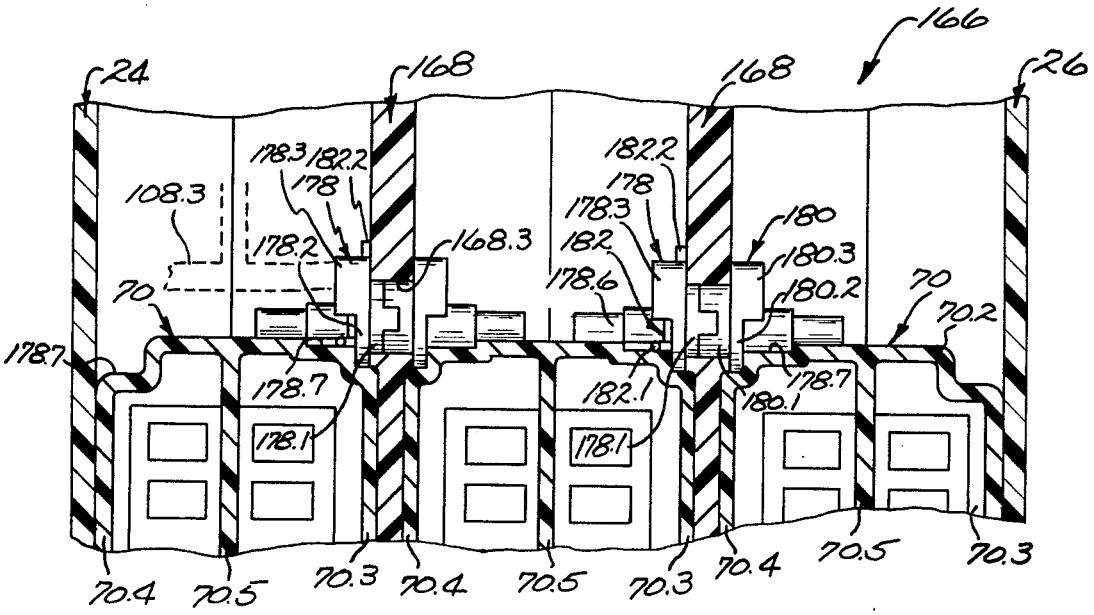
FIG. 26 is a partial section view along line 26—26 of FIG. 25.

Circuit breaker components mounted in the chamber 28 of the circuit breaker 10 previously described are mounted in each of the chambers 28 of the circuit breaker 166 as shown in FIGS. 24–26 so that each pole of the circuit breaker is adapted to function as does the circuit breaker 10.

In accordance with this invention, the circuit breaker mechanisms in the various housing chambers 28 are coupled together so that all poles of the multipole breaker are adapted to be manually opened or manually closed at the same time and so that, when one pole of the circuit breaker open automatically in response to an overload current in that pole, the other poles of the multipole breaker are also opened promptly therafter. Thus, as is shown in FIG. 23, a handle tip pin 174 is snugly fitted into the holes 14.9 in the operating handles 14 of the breaker 166 and through helical coil springs 176 (only one of which is shown) disposed between adjacent pairs of the handles 14. The tie pin preferably has a slight taper 174.1 at least at one end and has at least one peripheral groove 174.2 therein, preferably tapered at each side as shown, which is located so that, when the pin extends between the operating handles 14 as in FIG. 23, the peripheral groove 174.2 is aligned with a side edge of one of the handles 14. The springs 176 are proportioned to fill the space between each adjacent pair of operating handles when the spring is substantially fully compressed to its shortest length whereby the springs serve to space the adjacent handles from each other. At least one of the springs also has a convolution 176.1 at one end which is of lesser diameter than the other spring convolutions. Preferably for example, one end of the convolution is bent to have a chord configuration. This convolution is located to fit within the peripheral groove 174.2 in the tip pin when the tie pin is in the position shown in FIG. 23, thereby to retain the tie pin in that position. In this arrangement, the operating handles of the multipole circuit breaker 166 are easily coupled together by inserting the tapered pin end through the handle openings 14.9 and alternately through springs 176 in sequence until the spring convolution 176.2 snaps into the grooves 174.1 in the pin. This assembly of the tie pin is easily accomplished by feel and does not require any careful handling. In this way the pin is retained in the position shown in FIG. 23 and the handles are securely coupled together for movement together in manually opening and closing the poles of the circuit breaker. However, if uncoupling of the handles is desired, the tie pin is merely pushed axially from one end thereof with a nail-like tool until the spring end 176.1 rides up on the groove taper and snaps out of the pin groove 174.2, whereupon the pin is then easily slid out of the handle holes 14.9 and out of the spacing spring 176. The purchaser of the circuit breaker is able to remove and then replace the gauging rod easily if this is required for mounting the breakers on control panels.

In accordance with this invention, the casing section 168 also has an aperture 168.3 therein providing communication between adjacent housing chambers 28 in the multipole breaker 166. See FIGS. 24–26. A pair of multipole actuating members 178 and 180 are then fitted together within the aperture 168.3 to mount the actuating members 178 and 180 for pivotal movement within respective adjacent chambers 28. That is, the actuator member 178 has a splined bushing part 178.1 extending into the aperture 168.3 to be coupled in closely fitted engagement with a correspondingly splined housing part 180.1 of the other actuator member. Each actuator member also has an arm 178.2 and 180.2 extending from the bushing, the arms each having an abutment 178.3 defining a cam surface 178.4 and 180.4. The actuator member 178 has a spring stop abutment 178.5 on its arm adjacent the bushing part and has a shaft 178.6 extending from the actuator to rest in grooves 178.7 on top of the arc chute member 70. In this way, engagement of the arc chutes 70 with parts of the actuators 178 and 180 retain the actuators in the aperture 168.3. A spring 182 is fitted over at least one of the actuators such as 178 with one spring end 182.1 engaging the adjacent edge wall of the arc chute 70 and with its opposite end 182.2 engaging a stop such as 178.5 to bias the actuator members for clockwise movement as viewed in FIGS. 24 and 25.

The aperture 168.3 in the casing section is located, and the actuators 178 and 180 are proportioned, so that the abutments 178.3 and 180.3 of the actuator members are normally biased by the spring 180 into engagement with side walls of the arc chute member 70, the abutments having sufficient thickness to extend over contact chambers 70.6 and 70.7 formed by the arc chutes in the respective chamber 28. Thus, when one pole of the circuit breaker 166 is closed as illustrated in FIG. 24, the actuator abutment 178.3 overlies part of the movable contact arm 76 in that pole. Accordingly, if that pole of the circuit breaker should open in response to an overload current in the pole circuit so that the contact arm moves to the open circuit position shown in FIG. 25, movement of the arm 76 engages the actuator abutment, rotates the actuator within that pole to the position shown in FIG. 25, and, because that actuator is splined to a corresponding actuator 180 in the adjacent pole, rotates the actuator 180 in a similar way. The cam surface 180.4 of the other actuator then engages the rod-like lateral extensions 108.8 indicated by broken lines in FIGS. 24–26 on the tripping member of the linkage 18 in the adjacent pole for tripping that linkage to open the circuit in the adjacent pole. Upon subsequent reclosing of the circuits of the breaker 166, the actuators 178 and 180 return to the positions shown in FIG. 24 under bias of the spring 182. Of course, if all poles of the multiple breaker should be subject to simultaneous overloads the breaker poles may open substantially simultaneously without reliance on the actuators 178 and 180.

In this arrangement, the multipole circuit breaker is as easily and accurately assembled as the circuit breaker 10 and incorporates only a limited number of low cost components differing from those used in the breaker 10.

Further, each pole of the breaker 166 includes a calibration system 22 which is readily accessible from the exterior of the pole even after the multipole circuit breaker has been fully assembled. Thus the breaker 166 is adapted to be calibrated after its assembly as a multiple breaker, whereby more accurate calibration of the breaker poles is easily accomplished. Further, test openings 42 are accessible in each pole and the multipole breaker is easily tested after assembly and is easily disassembled without damage to breaker components if such testing should indicate that any breaker component is functioning improperly. The breaker 166 is compact and rugged and each pole of the header is conveniently adapted for series, shunt, or relay trip operation, for auxiliary switch operation, or for flux switch type circuit breaker application as may be desired.

It should be understood that all of the circuit breaker embodiments as described above are proportioned so that they are readily adaptable for A.C. or D.C. operation, for single pole or multipole operation, for time delayed or instantaneous operation, for 50, 60 or 400 hertz A.C. operation, and for auxiliary switch or flux switch type operation by simple substitution of magnetic actuation coils, terminals, casing sections or the like. All of the breakers are adapted to be easily and accurately assembled without requiring performance of time consuming, expensive or critical hand adjustments at assembly. All of the breakers are easily tested and calibrated and are easily dissassembled after such testing with full salvageability of all components.

The improved collapsible linkage, double break contact, and auxiliary switch system described herein is described and claimed in the commonly assigned, copending application for patent of Aime J. Grenier, Ser. No. 755,514.

(Attorney Docket 15532), filed of even date herewith.

The improved core, clapper and coil mounting and flux switch magnetic circuit system described herein is described and claimed in the commonly assigned, copending application for patent of Aime J. Grenier, Ser. No. 755,515.

(Attorney Docket 15595), filed of even date herewith.

The improved housing and mounting system described herein is described and claimed in the commonly assigned, copending application for patent of Aime J. Grenier, Ser. No. 755,780. (Attorney Docket 15594), filed of even date herewith.

The improved calibration system described herein is described and claimed in the commonly assigned, copending application for patent of Aime J. Grenier, Ser. No. 755,516.

(Attorney Docket 15592), filed of even date herewith.

It should be understood that although particular embodiments of this invention have been described above by way of illustrating the invention, the invention includes all modifications and equivalents of the described embodiments falling within the scope of the appended claims.

I claim:

1. A multipole circuit breaker comprising a plurality of housing sections secured together in side-by-side relation for forming a plurality of housing chambers between respective pairs of the sections; and, in each chamber, fixed contact means, movable contact means movable between a position engaging the fixed contact means for closing a circuit and a position spaced from the fixed contact means for opening said circuit, means biasing the movable contact means to said open circuit position, an operating handle extending from the chamber to be manually moved between corresponding open and closed circuit positions, linkage means connecting the operating handle to the movable contact means, said linkage means having a tripping member pivotally movable thereon between a first position permitting the movable contact means to be moved between said open and closed circuit positions in response to manual movement of the operating handle and a second position permitting the movable contact means to move to said open circuit position in response to said biasing means independently of the position of the operating handle, means responsive to conditions in the breaker circuit for moving the tripping member to said second position on the occurrence of selected conditions in said circuit, and at least one multipole actuator member having a cam portion thereon, said actuator member being pivotally mounted on a housing section for movement between a first and a second position, said actuator member having said cam portion disposed to be engaged when in in said first position of the actuator member by movement of said movable contact means to said open circuit position for moving the actuator member to said second position thereof, said actuator member having said cam portion disposed to engage and move the tripping member from its first position to its second position when said actuator member is moved into said second position of the actuator member; said circuit breaker having openings in the housing sections extending between each pair of adjacent housing chambers, said circuit breaker having pairs of said multipole actuators in respective adjacent housing chambers each having a splined shaft extending into one of said openings and secured in splined engagement with corresponding shaft portion of the other actuator member of said pair in the adjacent housing chamber for mounting the actuator member for said pivotal movement and for connecting the members together for common movement with each other; whereby movement of the movable contact means in one housing chamber to open circuit position on the occurrence of said selected circuit conditions initiates pivotal movement of at least one pair of said multipole actuator members to said second positions of the members for moving the tripping member in an adjacent housing chamber to open the circuit in said adjacent housing chamber as said actuator members are moved into said second positions of the members.

2. A multipole circuit breaker as set forth in claim 1 having said actuator members formed of a dielectric material, said members having plate portions of the multipole actuator members fitted over said openings and slidably engaged with said housing sections during pivotal movement of the multipole actuators for sealing said openings, and having said cam portions extending from respective plate portions to engage said movable contact means and said tripping member.

3. A multipole circuit breaker as set forth in claim 2 having spring means biasing said multipole actuator members away from said tripping members.

4. A multipole circuit breaker comprising a plurality of housing sections secured together in side-by-side relation for forming a plurality of housing chambers between respective pairs of the sections; and, in each chamber, fixed contact means, movable contact means movable between a position engaging the fixed contact means for closing a circuit and a position spaced from the fixed contact means for opening said circuit, means biasing the movable contact means to said open circuit position, an operating handle extending from the chamber to be manually moved between corresponding open and closed circuit positions, linkage means connecting the operating handle to the movable contact means, said linkage means having a tripping members pivotally movable thereon between a first position permitting the movable contact means to be moved between said open and closed circuit positions in response to manual movement of the operating handle and a second position permitting the movable contact means to move to said open circuit position in response to said biasing means independently of the position of the operating handle, means responsive to conditions in the breaker circuit for moving the tripping member to said second position on the occurrence of selected conditions in said circuit, and at least one multipole actuator member pivotally mounted on a housing section to be engaged by movement of said movable contact means to said open circuit position to be moved to engage and move the tripping member from its first position to its second position; said circuit breaker having pairs of said multipole actuators in respective adjacent housing chambers connected together for common movement with each other, whereby movement of the movable contact means in one housing chamber to open circuit position on the occurrence of said selected circuit conditions pivots at least one pair of said multipole actuator members for moving the tripping members in an adjacent housing chamber to open the circuit in said adjacent housing chamber; said multipole circuit breaker having apertures in the respective operating handles axially aligned with each other, having a tie-pin extending through said handle openings coupling the handles together for common movement with each other, having at least one peripheral groove extending around the tie-pin at a location between a pair of the operating handles and having at least one coil spring fitted over the tie-pin extending between said pair of handles, said coil spring having a convolution thereof of lesser diameter than other spring convolutions fitted into said pheripheral groove for detachably retaining the tie-pin in the operating handle openings.

5. A multipole circuit breaker as set forth in claim 4 having said groove aligned with an edge of one of said pairs of operating handles and having said coil spring convolution of said lesser diameter disposed at one end of the coil spring.

6. A multipole circuit breaker as set forth in claim 4 wherein a coil spring is fitted over the tie-pin between each adjacent pair of the operating handles, each of said coil springs having a compessed length corresponding to the separation of the adjacent operating handles for spacing the adjacent operating handles from each other.

7. In a multiple circuit breaker having a plurality of operating handles to be manually moved for opening and closing breaker circuits, said operating handles having respective openings therein axially aligned with each other, a tie pin extending through said handle openings to couple the handles together for common movement, said tie pin having at least one peripheral groove extending around the tie-pin and at least one coil spring fitted over the tie-pin extending between a pair of said handles, said coil spring having a convolution of lesser diameter than other spring convolutions fitted into said peripheral groove for detachably retaining the tie-pin in the operating handle openings.

8. A multipole circuit breaker as set forth in claim 5 wherein said groove is aligned with an edge of one of said pair of operating handles and said coil spring convolution of lesser diameter is disposed at one end of the coil spring.

9. A multipole circuit breaker as set forth in claim 7 wherein a coil spring is fitted over the tie-pin between each adjacent pair of the operating handles, each of said coil springs having a compressed length corresponding to the separation of the adjacent operating handles for spacing the adjacent operating handles from each other while axially positioning the tie-pin relative to the handles.

* * * * *